United States Patent [19]

Showalter et al.

[11] 4,318,868

[45] Mar. 9, 1982

[54] ANALOG CARBURETOR

[75] Inventors: M. Robert Showalter, Madison, Wis.; John M. Clark, Jr.; J. Wray Fogwell, both of San Antonio, Tex.

[73] Assignee: Automotive Engine Associates, Madison, Wis.

[21] Appl. No.: 246,028

[22] Filed: Mar. 20, 1981

Related U.S. Application Data

[63] Continuation-in-part of Ser. No. 136,084, Mar. 31, 1980, abandoned.

[51] Int. Cl.[3] ..... F02M 7/22

[52] U.S. Cl. ..... 261/41 D; 261/44 F; 261/50 R; 261/65; 261/67; 261/69 R; 261/DIG. 78

[58] Field of Search ..... 261/41 D, 44 F, 50 R, 261/65, 67, 69 R, DIG. 78

[56] References Cited

U.S. PATENT DOCUMENTS

| | | | |
|---|---|---|---|
| 1,369,419 | 2/1921 | Gibford | 261/67 |
| 1,450,762 | 4/1923 | Summers | 261/44 F |
| 2,269,275 | 1/1942 | Lichtenstein | 261/69 A |
| 2,491,760 | 12/1949 | Orr, Jr. | 261/69 A |
| 2,733,901 | 2/1956 | Sutton | 261/69 A |
| 3,409,276 | 11/1968 | Fuchs | 261/50 R |
| 3,807,710 | 4/1974 | Bergamini | 261/69 A |
| 3,903,215 | 9/1975 | Cole et al. | 261/65 |
| 4,000,224 | 12/1976 | Phelps et al. | 261/41 D |

FOREIGN PATENT DOCUMENTS

| | | | |
|---|---|---|---|
| 2448442 | 4/1975 | Fed. Rep. of Germany | 261/50 A |
| 924712 | 8/1947 | France | 261/69 R |
| 610193 | 10/1960 | Italy | 261/69 R |
| 413306 | 7/1934 | United Kingdom | 261/69 R |
| 718381 | 11/1954 | United Kingdom | 261/69 R |
| 1191206 | 5/1970 | United Kingdom | 261/50 A |

*Primary Examiner*—Tim R. Miles
*Attorney, Agent, or Firm*—Witherspoon & Hargest

[57] ABSTRACT

A fuel-air metering system functioning according to precise flow and geometrical equations. An air throttle valve and fuel valve are positively linked with the flow crossectional area of each valve proportional to that of the other. Fuel pressure drop across the fuel valve is regulated in precise proportion to the pressure drop across the upstream orifice of a two orifice in series air flow system which bypasses the air throttle. Careful shaping of the air throttle, the bypass system orifices, the fuel valve, passage geometry, and the servo valve fuel regulation system results in an accurate porportioning of fuel flow to air flow.

30 Claims, 11 Drawing Figures

FOR 50% RECOVERY $\beta = .62$ $$\beta = \frac{D\ ORIFICE}{D\ OUTLET}$$

ANALOG CARBURETOR

CROSS REFERENCE TO RELATED APPLICATIONS

This is a continuation in part of Ser. No. 136,048, filed Mar. 31, 1980 and now abandoned.

BACKGROUND AND OBJECTS

It is the purpose of the present invention to produce an intrinsically accurate and inexpensive fuel-air metering device for internal combustion engines. The necessity for accurate fuel-air metering to I.C. engines is well understood by those skilled in the art. As pressures to improve engine efficiency increase and particularly as pressures to reduce exhaust emissions become more intense, the requirements for metering systems have become more stringent. At present, these stringent requirements are forcing fuel-air metering systems to become more and more expensive, and are also involving increased maintenance problems. It is extremely difficult to reproducibly program carburetors with the accuracy required, and carburetors also have problems with lags and with pulsating fuel flows due to air bleeds. Fuel injection systems of one sort or another are replacing carburetors in many applications, but these units tend to be expensive. One virtue of fuel injection systems is improved distribution of fuel from cylinder to cylinder. However, one of the inventors has, with his colleagues Kenneth Kriesel and Charles Siewert, invented a mixing vortex system with essentially perfect cylinder to cylinder distribution. This mixer eliminates the distribution advantage of multiple fuel point introduction. The present invention was worked out to replace a conventional carburetor upstream of this vortex mixing device, and is designed from the first principles of the fluid dynamics governing the fuel and air flow to produce accurate and programmable fuel-air metering in an inexpensive way.

An important objective of the inventors was to work out a design which could be made to function precisely, and with the function of the system in very close agreement with precise mathematical formulas. A system which can be modelled precisely by straightforward mathematical formulas has significant practical advantages, in that it requires less development, permits rational design changes in the system to be made, and permits the system to be straightforwardly programmed according to specified requirements.

It is important to emphasize that all fuel-air metering systems must function on the basis of the fundamental laws of fluid mechanics. As a minimum, any fuel-air metering device which is not a positive displacement device will have fuel governed by the incompressible flow equation (Bernoulli's equation) and will have the air flow governed by the compressible flow equation. These equations are exact in the same physical sense that the basic equations of Newtonian physics are exact, and in the same sense that the tabulated thermodynamic functions (for instance, entropy, enthalpy, and internal energy) are exact functions. In real systems, the mathematical equations governing a physical event are never true to perfect exactness because of unavoidable errors in shape or measurement, and because of physical effects which complicate the equations excessively. With the flow passage shapes typically used in prior art carburetors the flow behavior of the passages generally differs by so much from the basic flow equations that the basic equations have had limited practical value. Consequently carburetor and other fuel-air metering devices have evolved on an empirical basis. However, there are flow passage shapes which do in fact follow simple mathematical flow relations with excellent accuracy; if proper care is given to geometrical shapes the difference between mathematically predicted flow and real flow may be too small to easily measure. The details which must be *tended to* to produce this close correspondence between theory and reality are somewhat complicated, and explanation of these details form a significant part of this application.

One of the very important objectives in designing the present invention fuel-air metering system was to produce structures where the errors in the flow equations were extremely small and exactly calculable, so that the system would obey the flow equations to an extremely good level of approximation. By taking pains with the structures to see that the fluid mechanical equations are in fact met to excellent approximation, it is possible to have a system which can be predicted and designed reliably on the basis of precise and straightforward mathematics. The present invention metering system involves only the compressible flow equation for air flows, the incompressible flow equation governing the fuel flow, and simple geometry. It is therefore a fundamentally simpler system than that involved with injection systems using solenoid valves, and also a much simpler system than conventional carburetors which have a multiplicity of interlocking air-fuel control systems which interact in complex and analytically intractable ways.

In addition to the more mathematical aspects of the metering system design, the inventors have considered a number of practical economic and structural issues. For example, the system is designed to be compatible with inexpensive low pressure diaphragm fuel pumps, although it is also compatible with higher fuel pressure systems. Any system designed to meter to high accuracy must have parts built to a similarly high level of accuracy, but the inventors have taken pains to make sure that the parts of the system which must be made to close tolerances can be made so by simple manufacturing techniques. In addition, issues of durability as well as dynamic response have been considered.

Another issue of importance is the flexibility of the system with respect to different control strategies. The present invention is adapted to easily connect with either conventional control via diaphragms or with electronic air/fuel ratio controls of one sort or another. The interaction of the metering system with its control system is in each case analytically clear and straightforward. In addition, the parts involved in the control system can be made with relatively large absolute dimensions, so that they can be made to high relative accuracies.

It is the purpose of this disclosure to teach one of ordinary skill in automotive engineering to make and use the current invention fuel-air metering system. With this end in mind, the mathematical relations involved in the metering system have been set out formally and in considerable detail. Moreover, specific design issues relevant to the accuracy of the fuel-air metering system in practice are addressed.

The aforedescribed objects and advantages will become more apparent when taken in conjunction with the following detailed description and drawings illustrating by way of example preferred embodiments of this invention.

IN THE DRAWINGS

Figure 3:
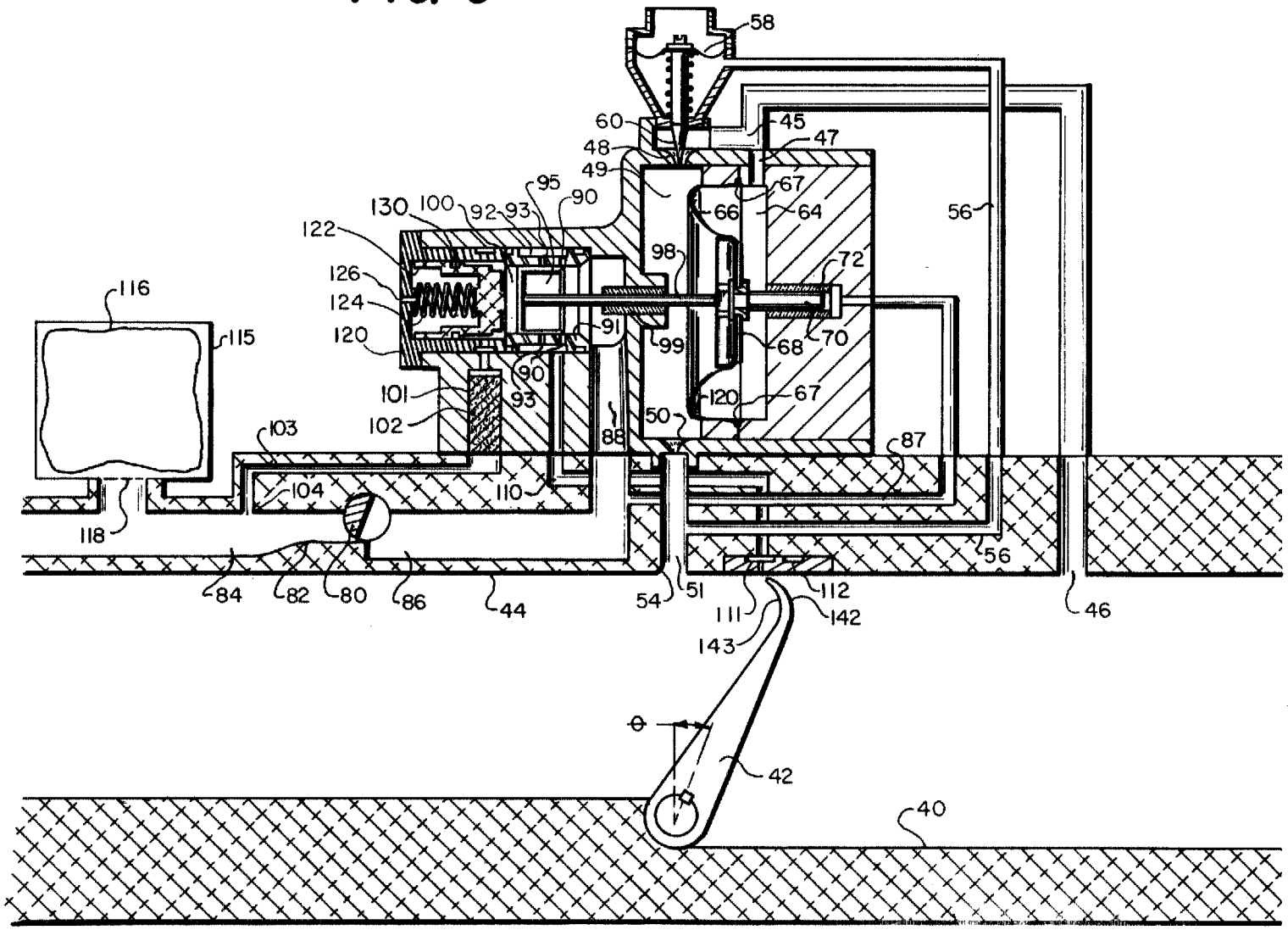

FIG. 3 shows a fuel air metering system with several of the fluid mechanical details more clearly shown. FIG. 3 is partly schematic, and shows the fuel control valve and air throttle in different places, although both of these valves are on the same shaft in the preferred form of the invention. FIG. 3 particularly shows the shape of the air throttle and details of the design of the pressure regulation system.

Figure 4:
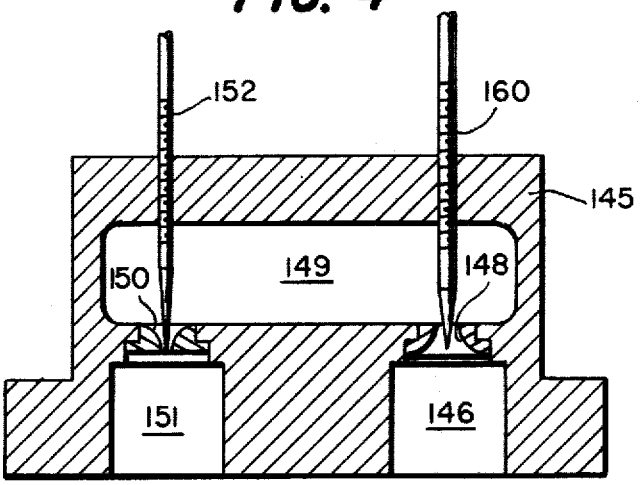

FIG. 4 shows a two orifice in series flow system in one of the preferred forms of the invention, illustrating particularly orifice shapes having coefficients of discharge which are insensitive to either Reynold's Number or Mach Number in the operating range of the system.

Figure 5A:
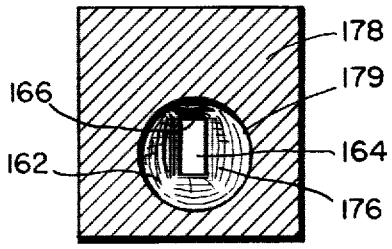
Figure 5:
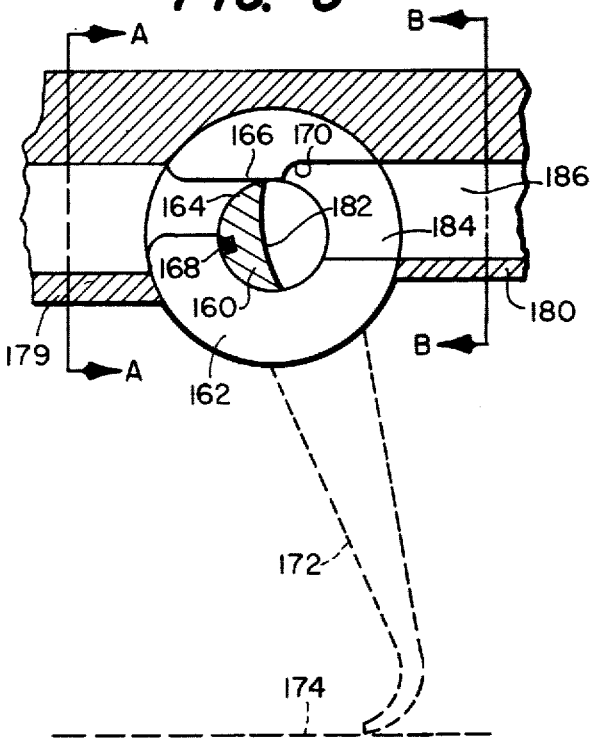

FIG. 5 is a cross-section of the fuel flow control valve which is linked directly to the air throttle, showing details important in producing a valve which obeys the proper geometrical equations and exhibits insensitivity of coefficient of discharge to Reynold's Number.

FIG. 5A is a sectional view taken on line A—A of FIG. 5, showing the upstream or convergent portion of the valve of FIG. 5.

Figure 5B:
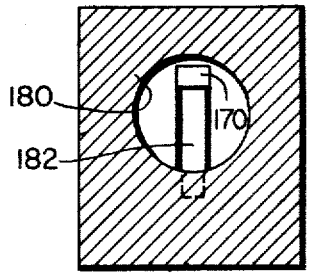

FIG. 5B is a sectional view taken along line BB of FIG. 5, showing the shape of the outlet of the valve producing very sudden expansions for minimum pressure recovery and minimum Reynold's Number sensitivity of the valve. With the minimized pressure recovery downstream of the valve, the flow in the downstream passages is nearly equal to the vena contracta static pressure downstream the variable orifice of FIG. 5.

Figure 6:
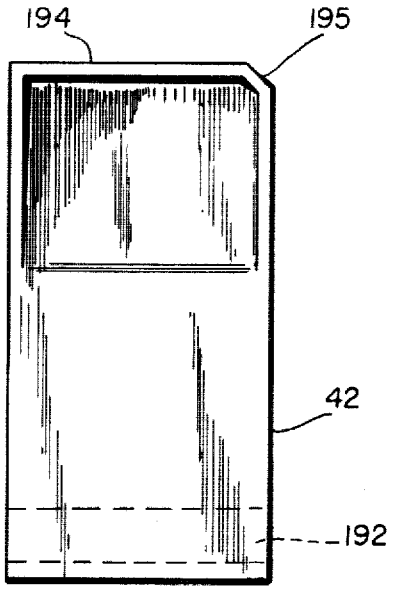

FIG. 6 is a view of the downstream side of the throttle plate of FIG. 3, showing a notched section for the idle air flow of the system.

Figure 7:
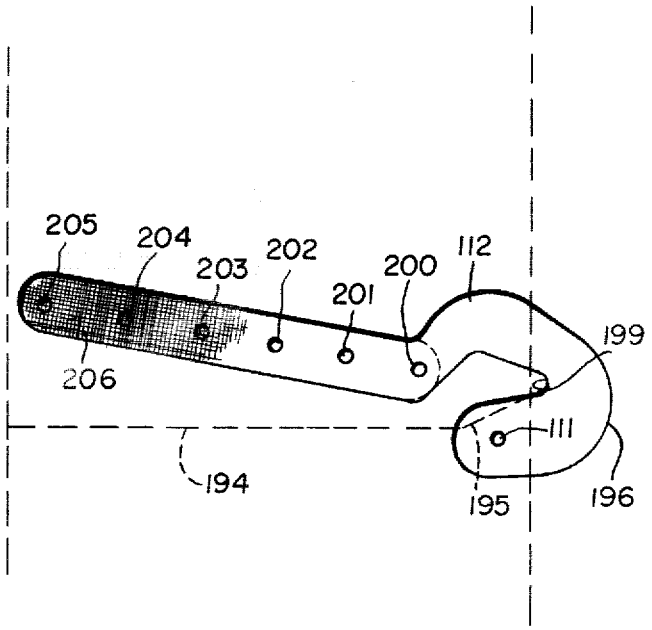

FIG. 7 is a plan view of the passage shown at 111 and 112 of FIG. 3, showing how the axial distribution of fuel into the high speed air stream is achieved, and how this distribution varies as the throttle opens.

Figure 8:
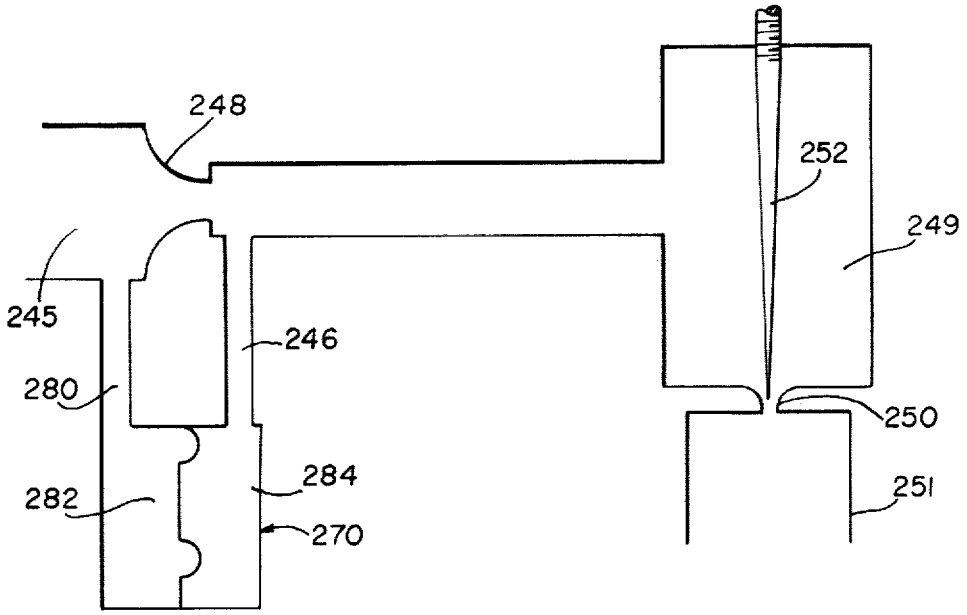

FIG. 8 is analogous to FIG. 4 and shows an upstream orifice arrangement where approximately 50 percent pressure recovery is obtained downstream of the upstream orifice. By making the diaphragm $\Delta p$ equal to the maximum $\Delta p$ of this orifice compressibility effects which would otherwise slightly degrade the accuracy of the metering system can be avoided.

Figure 9:
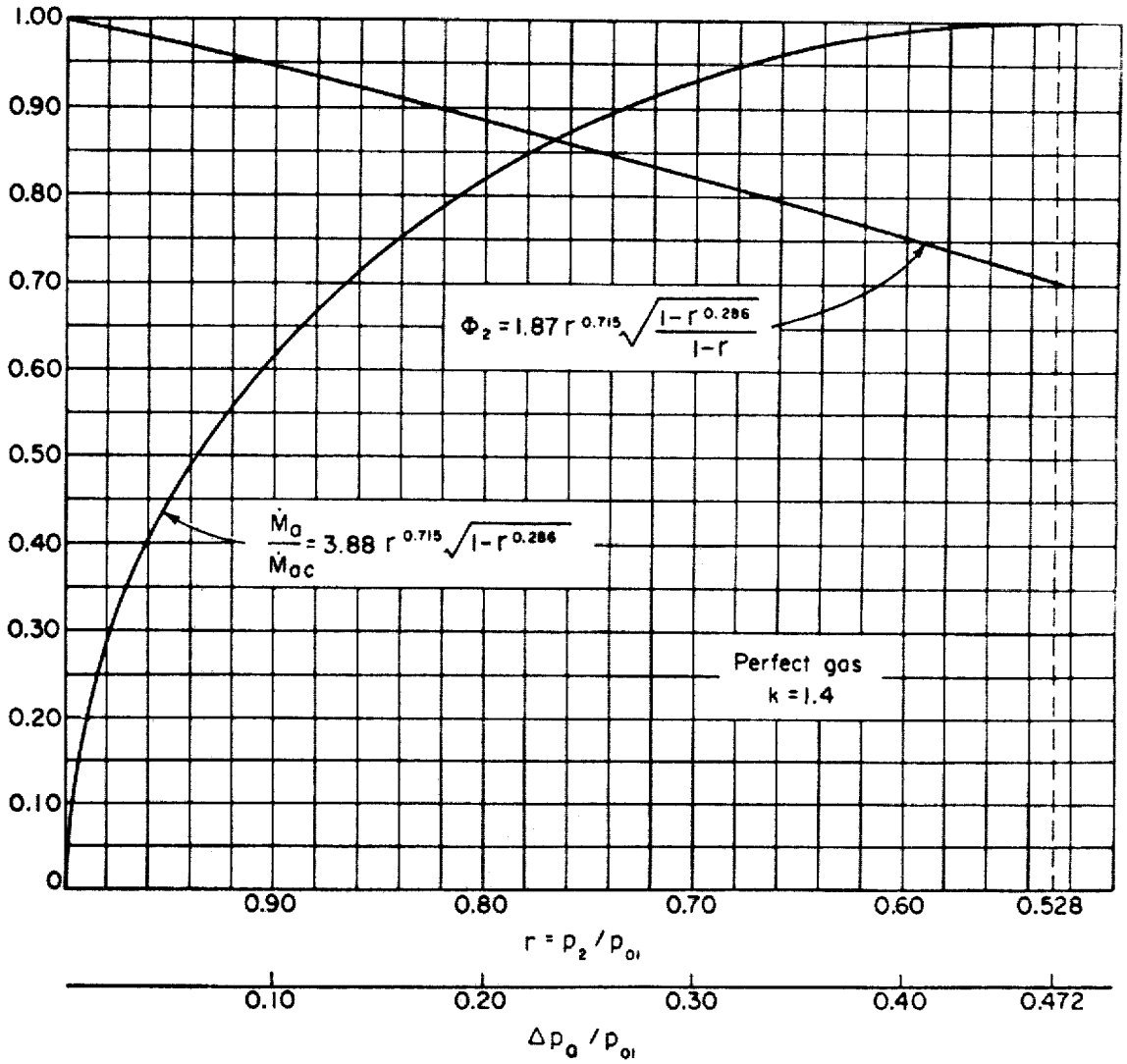

FIG. 9 shows important compressible flow relations, plotting particularly both the $\dot{M}a/\dot{M}ac$ ratio which shows the fraction of sonic mass flow occuring at a specific pressure drop, and also showing the compressibility function $\Phi_2$. FIG. 9 is copied from Page 197 of *The Internal Combustion Engine in Theory and Practice,* Vol. 2 by Charles Fayette Taylor, MIT Press, copyright 1968.

DETAILED DESCRIPTION

In the present metering system, the exact proportioning of fuel to air is obtained by achieving two conditions:

1. The metering system air control valve (throttle) and the fuel control valve are on the same throttle shaft (or are otherwise positively linked) and are arranged so that the effective flow areas of the air valve and the fuel valve stay in a fixed proportion as both valves open and close together.

2. The fuel flow per unit effective fuel valve area is maintained in fixed proportion to the air flow per unit effective air throttle area. This requires that the pressure drop across the fuel valve be controlled to vary in exact proportion with the square of the mass flow of air per unit area past the air throttle valve. This pressure regulation is achieved by a variable restriction servovalve which controls the pressure drop across the linked fuel valve in proportion to the pressure drop across the upstream orifice of a two orifice in series air flow bypass system.

Figure 1:
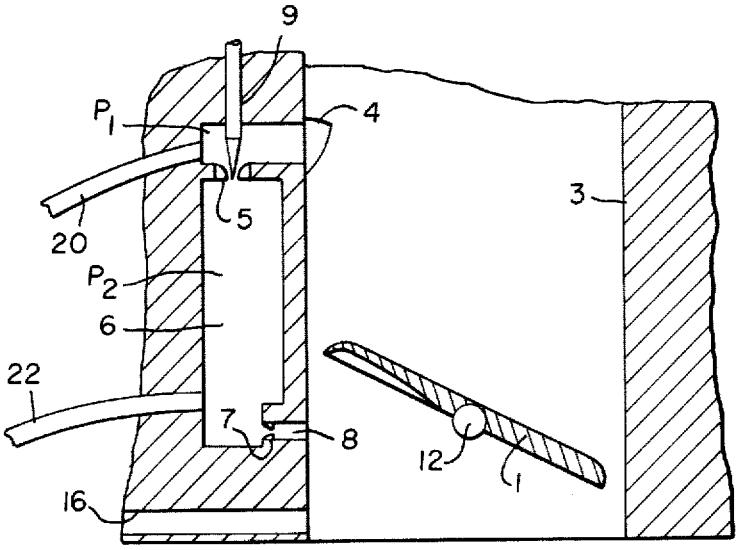
FIG. 1 shows an air flow passage with a specially adapted butterfly valve and with a two orifice in series air flow bypass system which generates the signal for controlling fuel pressure drop across a fuel control valve.
Figure 2:
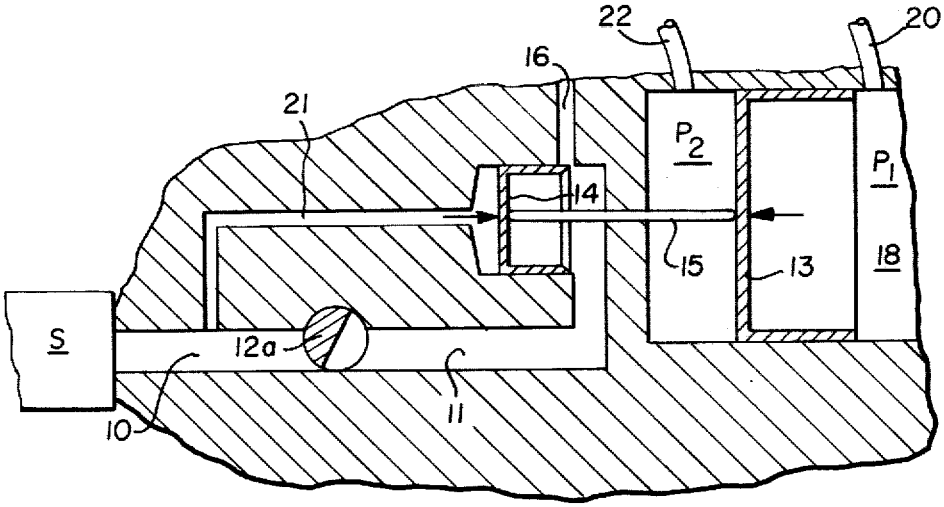
FIG. 2 shows the fuel flow control arrangement, including a fuel flow control valve linked directly to the butterfly valve throttle shaft and a regulation arrangement which sets the pressure drop across this variable orifice in proportion to the pressure drop across the upstream orifice of the two orifice in series bypass system shown in FIG. 1.

FIGS. 1 and 2 show the air circuit and fuel circuit of the metering system in schematic form.

Referring to FIG. 1, a throttle plate 1 pivots on shaft 12 in an air flow passage 3. Throttle plate 1 is specially shaped with smoothly convergent surfaces and with a vortex stabilizing contour on the upwardly pivoted side. This aerodynamic shaping of the throttle valve is required to achieve an air throttle having a coefficient of discharge at each opening position which is relatively insensitive to variations in Mach Number and Reynolds Number which occur due to variations in the pressure drop across the throttle. This shaping is important: conventional throttle plates exhibit variations in coefficient of discharge of as much as 30 percent, and this variation in coefficient of discharge is quite unacceptable in the current metering system.

A small fraction of the air flow past the carburetor passes through an air flow bypass system which generates a pressure differential used to control the fuel pressure differential across the fuel valve. Intake air passes into opening 4 at approximately stagnation pressure with respect to throttle 1 and this flow is sucked past a fixed orifice 5 which discharges into a relatively open passage 6. Air from passage 6 is sucked past fixed orifice 7 into passage 8. Passage 8 is located in a position where it is in contact with a pressure which approximates the vena contracta static pressure downstream of throttle 1. Orifice 7 is significantly smaller than orifice 5. The pressure drop across orifice 5 is small, so that air flowing past orifice 5 acts as an approximately incompressible fluid, in good analogy with the incompressible liquid fuel. Since the pressure drop across orifice 5 is small, the pressure drop across fixed orifice 7 is almost exactly equal to the pressure drop across air throttle 1. Orifice 7 is designed to have a coefficient of discharge insensitive to Reynolds Number and Mach Number. The air flow past orifice 7 varies in almost exact proportion to the air flow per unit area past air throttle 1. The air flow past orifice 5 is exactly equal to the flow past orifice 7, and the pressure drop across orifice 5 varies to good approximation with the square of flow through orifice 5. The pressure drop across orifice 5 is therefore a good signal for proportional control of fuel pressure drop across the fuel valve. Movement of needle 9 changes the effective flow area of orifice 5, and changing this flow area is a convenient way of changing the air fuel ratio supplied by the system.

FIG. 2 shows the fuel control arrangement which includes a fuel valve opening in proportion to the air throttle opening and a negative feedback fuel pressure drop regulation system controlling pressure drop across this valve in proportion to the pressure drop across air orifice 5. On the same shaft as throttle shaft 12 is slotted shaft plug fuel valve 12*a*, which rotates within a receiving passage so as to have an effective flow area varying in precise proportion to the opening of air throttle 1. In preferred forms of the invention, this slotted shaft is on the throttle shaft, so that there is a zero lag and extremely positive linkage between fuel valve opening and air throttle opening.

Fuel air metering requires that the pressure drop across slotted shaft valve 12*a* vary in proportion to the pressure drop across orifice 5. The pressure drop across fuel valve 12*a* is varied in proportion to the pressure differential across air flow orifice 5 by fuel pressure regulator assembly 13, 14, 15, 16. A very low friction air piston 13 (which may have to be supported on hydrostatic bearings) is connected on its left face to a connecting passage 22 which connects to passage 6 at the pressure downstream of orifice 5. On the right side of air piston 13 is the pressure upstream of orifice 5, which is communicated by connecting passage 20. The pressure drop across orifice 5 therefore produces a leftward force on piston 13 equal to the area of piston 13 times the pressure drop across orifice 5. This leftward force is transmitted by a thin cylindrical connecting rod 15 to fuel control piston valve 14 which rides in a cylinder on essentially frictionless hydrostatic gasoline bearings. The fuel control valve piston 14 is connected on its left side to fuel pressure upstream of fuel valve 12*a* by passage 21, and on its right side is connected downstream of valve 12*a* by passage 16; the pressure differential across the fuel valve 12*a* generates a rightward force on piston 14 equal to this pressure drop times the area of piston 14. At equilibrium the rightward force from piston 14 balances the leftward force from air piston 13; if the system is not in equilibrium, it will tend to move axially.

Axial motion of assembly 14, 15, 13 will rapidly change the pressure drop across piston 14, and this change will act to restore equilibrium. Axial motion of piston 14 opens and closes fuel flow area to passage 16, and the orifice forced by piston 14 and passage 16 is the only orifice in series with fuel valve 12*a*. Passage 16 feeds fuel to the engine. Assembly 14, 15, 13 acts as a servo controlled valve system controlling the pressure drop across the sleeve of piston 14 (the pressure difference between passage 11 and passage 16). Because passage 16 is the only outlet for fuel which flows past valve 12*a*, the axial position of piston 14 directly controls the pressure drop across valve 12*a*, and hence the fuel flow of the metering system. If assembly 13, 15, 14 doesn't stick, piston 14 will move to an axial position producing an exact force balance.

A force balance between fuel piston 14 and air piston 13 means that the fuel pressure drop across fuel valve 12*a* is proportional to the pressure drop across air orifice 5, which is what is required to produce a set air-fuel ratio from the analog carburetor The fuel flow control system of FIG. 2 will work well if details are well handled and if the fuel pressure supplied to passage 10 is sufficient and smooth enough.

A fuel air metering system such as that shown on FIGS. 1 and 2 has operated successfully and with excellent accuracy on a test stand at Southwest Research Institute. The function of the system is rather simple and straightforwardly described with exact mathematics. Air flow past an air throttle 1 obeys to excellent approximation the standard compressible flow equation found in engineering textbooks. The air flow throttle is positively linked with a fuel flow valve so that the fuel flow metering area is proportional to air throttle opening. A two orifice in series air bypass system generates a flow signal closely proportional to the square of the mass flow per unit area past the throttle. A negative feedback fuel regulator assembly controls fuel pressure drop across the fuel metering valve in proportion to the signal generated in this bypass system by regulating the flow resistance of an orifice in series with the fuel valve, thereby varying flow until pressure drop across the fuel control valve is in balance.

The air flow relations in the air flow system shown in FIG. 1 work very well, but there are some practical problems of detail in the fuel control system shown in FIG. 2. First of all, the details of valve 12*a* are not shown in enough detail to show how it can have an effective flow area which varies in precise proportion to the air throttle. There are a number of problems with the control system otherwise. Both fuel control piston 14 and air piston 13 are prone to excessive friction and sticking. Friction or sticking can produce significant metering errors. The pressure drop between passage 11 and passage 16 produces a sideward force between piston 14 and the cylinder in which it rides, and this force makes the motion of 14 unacceptably sticky. It is very difficult to produce an air piston 13 with the very low friction required of the system, particularly if a durable system is required, and stickyness of piston 13 is also a cause of inaccuracy. Even if the friction in pistons 14 and 13 were zero, and if the sliding friction of connecting rod 15 was also zero, there would be an error in the system due to a pressure imbalance across the cross sectional area of connecting rod 15. There is also the issue of the servo mechanical stability of the servo controlled valve formed by piston 14 and its cylinder opening to passage 16. The system is a non-linear negative feedback servo of a sort which is susceptible to oscillation, so that the system needs an exactly linear damping characteristic if it is to operate accurately.

FIG. 3 shows solutions to these problems and has other advantages. The air flow passages and fuel flow passages in the metering system of FIG. 3 are very closely analogous to those of FIGS. 1 and 2. The air flow passages analogous to FIG. 1 are as follows: throttle 42 pivots in generally rectangular passage 40 and forms a variable area air throttle. The coefficient of discharge of air throttle 42 has been shown experimentally to be very insensitive to Mach Number and Reynolds Number variations. Flow from throttle 42 proceeds to downstream wall 44, and attaches in the form of a coanda wall attached stream to this wall. Well upstream of throttle 42 is pick up passage 46, which is shown schematically (in a proper system pick up 46 would be in a large enough passage so that it was picking up air at upstream stagnation pressure). Flow from pick up 46 moves through low flow resistance passage 45 and passes through orifice 48, which is analogous to orifice 5. Downstream of orifice 48 is relatively large passage 49, which is large enough to dissipate the velocity of flow from orifice 48 and feed a relatively homogenous air flow to downstream orifice 50, which is analogous to orifice 7. Orifice 50 feeds passage 51 which is connected to the wall of passage 44 on which the high speed flow from air throttle 42 is attached. The downstream corner of the connection between passage 51 and air flow wall 44 is curved at 54, so flow from passage 51 merges smoothly with the main airflow and passage 51 contains a fluid at a pressure very close to the downstream vena contracta static pressure of air throttle 42.

Variation of the effective open area of orifice 48 as a function of engine intake manifold vacuum is obtained by diaphragm assembly 58, which moves needle 60 in response to variations in the pressure of passage 56, which passage taps passage 51. The diaphragm control for needle 60 achieves a controlled enrichment of the mixture at low intake manifold vacuums.

Diaphragm assembly 66, 68, 70 separates two chambers, chamber 64 is at the upstream pressure of orifice 48 and the other chamber 49 is at the downstream pressure of orifice 48. The diaphragm assembly functions analogously to piston 13 in FIG. 2. Thin diaphragm 66 joins around its outside at peripheral connection 67 and is mounted on diaphragm cup 68. Cup 68 is rigidly connected to circular rod 70 which rides in bushing 72 so that rod 70 and bushing 72 provide axial alignment of the diaphragm assembly. The rightward side of the diaphragm assembly is at the pressure of chamber 64 which is connected through passage 47 to passage 45, approximately upstream throttle stagnation pressure. On the left side of the diaphragm assembly is chamber 49, which is at the pressure directly downstream of orifice 48. Diaphragm assembly 66, 68 produces a leftward force on connecting rod 98 carried in bushing 99 to form part of a servo-controlled fuel valve assembly very analogous to the assembly 14, 15 of FIG. 2.

The fuel flow circuit is analogous to FIG. 2, and is partly shown schematically with details shown with respect to the fuel control servo valve arrangement. Pressurized fuel in relatively large passage 84 is supplied by a pumping arrangement (not shown) and fuel from 84 passes convergently into rectangular passage 82 which is closed off by slotted plug valve 80, which is shown schematically on FIG. 3 and is preferred to be on the same shaft as the air throttle 42, in a manner further shown in FIG. 5. Flow past slotted plug variable area valve 80 flows into a large expansion area 86, in a flow pattern characterized by Reynolds Number insensitivity and approximately complete dissipation of downstream flow energy by turbulence, so that the pressure in passage 86 approximates the vena contracta static pressure directly downstream of plug valve 80. Passage 86 is large and characterized by low fluid resistance. Passage 86 feeds passage 88, of similarly low resistance. Large passage 88 flows from a relatively large area into a piston controlled servo valve area.

Piston 95 rides on cylinder sleeve 91. In sleeve 91 are symetrically located ports 90, which ports are arranged to produce symmetrical pressure forces so that side forces on piston 95 due to pressure drops from the pressure of passage 88 to the pressure of passage ports 90 do not produce any net side forces tending to stick piston 95. Piston 95 has a knife edged shape on its piston skirt, and axial motion of piston 95 in sleeve 91 moves the knife edged skirt opening and closing ports 90 so that the interaction of piston 95 with ports 90 forms a servo controlled valve. Ports 90 feed an annular passage 92 around the outside of sleeve 91, and passage 92 feeds passage 110. Passage 110 feeds fuel to the airstream (and hence to the engine) via a distribution port arrangement 111, 112 described further in FIG. 7. Static friction of piston 95 in cylinder sleeve 91 is further balanced by hydrostatic pressure balancing holes 93 symetrically spaced in sleeve 91, which holes serve to center piston 95 in the manner of a hydrostatic bearing.

Piston 95 opening and closing ports 90 is a servo controlled valve which operates in close analogy to piston 10 of FIG. 2. On the right side of piston 95 is a pressure very near to the downstream vena contracta static pressure downstream of variable area control valve 80. It has been found experimentally that with piston 95's skirt knife edge as shown, the fluid motion near piston 95 has very small effects on the pressure on this side of the piston. On the left side of piston 95 is chamber 100 which connects through a laminar flow filter 102 positioned in passage 101 with the pressure at pick-up port 104. The laminar flow filter 102 (which can be conveniently formed of a conventional cigarette filter) functions well to damp any oscillation in servo-piston valve 95, since any axial motion of piston 95 requires that flow pass through this filter. It turns out that damping directly proportional to the axial velocity of piston 95 is precisely what is required for error free servo mechanism performance. The laminar flow cigarette filter provides this damping and also serves to filter small particles which might otherwise cause piston 95 to stick in cylinder sleeve 91.

The function of the servo controlled valve assembly 91, 98, 90, 95, 66, 68, 70 is substantially superior to that of the system shown in FIG. 2. The diaphragm arrangement has been shown to have essentially vanishing hysteresis and static friction. Engine vibration is sufficient to essentially eliminate static friction in connecting rod 98 and compensating rod 70. The arrangement of ports 90 and 93 within sleeve 91 substantially eliminates the sticking of piston 95 within the cylinder sleeve 91 if these parts are carefully made. The assembly forms an extremely accurate negative feedback servomechanism system, which is well damped by the laminar resistance of the cigarette filter in passage 101. This system has been shown to obey the equations which would be predicted in a free body diagram to an exceptional degree of exactness.

It is useful in the operation of the metering system of FIG. 3 to have a relatively steady pressure in chamber 84, and yet it is commercially useful to work with cheap diaphragm fuel pumps which produce fluctuating pressures. Air bag accumulator arrangement 115, 116, 118 is shown schematically to show how the two requirements can be satisfied at once. Inside container 115 is relatively flexible air bag 116 which contains air under pressure. At the connection between air bag 116 and passage 84 is mechanical grid 118, which serves to constrain the expansion of bag 116 toward passage 84. When pressure in passage 84 is below the air pressure in bag 116, bag 116 will expand hard against grid 118, and the accumulator will act as though it is almost incompressible (the rate of accumulation with pressure change will be nearly zero if pressure is below a set air bag pressure). When the pressure in passage 84 becomes significantly larger than this air bag set pressure, however, the bag 116 will be compressed in pressure and will reduce in volume, so that fuel from passage 84 will flow within container 115. Under these conditions, the accumulator bag 116 will serve very strongly to damp out pressure fluctuations which might otherwise occur from a pulsating pump. Many such accumulator arrangements are old, and they can be made inexpensively.

All aspects of FIG. 3 analogous to the passages in FIG. 1 and FIG. 2 have now been described. FIG. 3 also shows a simple and effective evaporative emisson control, which closes off flow to passage 110 when the engine stops and fuel pressure in passage 84 drops. The system is intended to be used with a fuel pump arranged to leak down pressure when the engine stops. Such a pump is not shown, although many such pumps will occur to those skilled in the art. In the evaporative control system, a plug carrier 120 coaxial with piston 95 carries spring-piston arrangement 124, 122, with piston 122 slidably carried within the cylindrical passage of plug character 120 and sealed with a relatively low friction O-ring seal 130. Piston 122 is pushed rightward by spring 124. Port 126 and thence the passage containing spring 124 is connected to an engine manifold pressure (connection not shown). When fuel pressure in chamber 100 is at the values corresponding to engine operation, the pressure force in chamber 100 forces piston 122 leftward to the position shown. When, however, the engine is shut off, pressure in chamber 100 drops and spring 124 pushes piston 122 rightward, until piston 122 contacts piston 95 and pushes piston 95 to a position which fully closes ports 90 as well as ports 93. After this point fuel leakage from the system is negligible. The system therefore controls evaporative emissions. The axial length of rod 98 and compensation rod 70 are arranged with respect to piston 95, sleeve 91, and the end of bushing 72, so that piston 95 stops in a position which fully closes off all passages to passage 110 when the engine is turned off. With cranking of the engine, piston 122 quickly shifts leftward and the system meters with negative feedback servo valve assembly 95, 91, 98, 66, 68, 70 operating as previously described.

The operation of the servo controlled valve depends for its accuracy on a very low friction, low hysteresis and low spring constant characteristic of the diaphragm 66. We found experimentally that present art diaphragms have excessively large spring constants and too much hysteresis for the accuracy we were attempting to get from the metering system. However, a diaphragm shape we derived analytically has been tested experimentally and has the exceptionally low stiffness characteristics required (stiffness and hysteresis values more than a factor of 10 less than those characteristic of conventional diaphragms). The shape of diaphragm 66 in FIG. 3 is the shape of this diaphragm when the diaphragm is undeformed (when the pressure drop across the diaphragm is negligibly small). As can be seen from the figure, the shape of the diaphragm is significantly different from conventional diaphragm shapes, and points in the diaphragm are shifted outward radially compared to the geometric shapes which are typical of the prior art. For example, consider point 120 on diaphragm 66. When the pressure drop across diaphragm 66 becomes significant, pressure forces will serve to change the shape of the diaphragm so that point 120 shifts radially inward. Virtually all other points on the diaphragm will similarly move inward radially. This means that the circumference of the diaphragm at any point will tend to be compressed by the inward radial motion of the diaphragm due to pressure forces, since circumference is proportional to radius. Pressure forces therefore deform the diaphragm, putting the diaphragm member in a circumferential compression. The membrane is exceptionally thin, and buckles rather than taking circumferential compression. At first glance, this buckling might be expected to stiffen the diaphragm and it does stiffen the diaphragm with respect to first order bending terms. However, the bulk of diaphragm stiffness occurs because of circumferential stretching which occurs as the diaphragm moves axially, and the buckled form of the diaphragm shape 66 totally eliminates these circumferential stress terms, and in consequence, produces a diaphragm which is an order of magnitude less stiff than that of prior art diaphragms. The diaphragm shaping of 66 is useful, since it permits diaphragms to be used in devices of much higher precision than has heretofore been possible. The resistance of diaphragm 66 to axial motion within the control range relevant to the servo control valve motion of piston 95 is essentially negligible, so that the diaphragm serves as an effectively zero friction piston which produces a force ideally suited for controlling servo valve piston 95.

The detailed shape of throttle 42 is important. First it can be clearly seen that the open area of throttle 42 varies as the angle $\theta$ increases according to the formula $A_a = b_1(K_1 - \cos\theta)$ $K_1 \leqq 1$. It should be clear that the projected open area of plug valve 80 with respect to its generally rectangular passage should be a quite similar equation $A_f = b_2(K_2 - \cos\theta)$ $K_2 \leqq 1$, The $K_s$ can be the same for both the fuel valve and the air valve, in which case the projected open area of both valves will vary in exact proportion. For conventional round butterfly valves, the air projected open area varies according to essentially the same relation, so that for both sorts of throttle valves a close proportioning between fuel flow valve area and air flow valve area is possible with a system which puts both valves on the same shaft.

Referring again to throttle 42, the shape of throttle 42 is arranged specifically so that it is very insensitive in its coefficient of discharge to variations in Mach Number and Reynolds Number which occur across it due to variations in the intake manifold vacuum of the system engine downstream passage wall 44. On the upstream side of throttle 42 is a smoothly convergent curve 142, which constrains the convergent streamlines upstream of the throttle valve, tending to stabilize the coefficient of discharge of the throttle. On the downstream side of the throttle 42 is cusp 143, which is arranged to stabilize a parasitic vortex driven by the high speed stream past the throttle. This vortex smoothly merges with this high speed stream and tends strongly to stabilize the shape of the vena contracta downstream of the throttle plate independently of Mach Number. It has been found experimentally at Southwest Research Institute that a throttle plate like throttle 42 is essentially Mach Number and Reynolds Number insensitive for all the manifold vacuums which occur at each angle of throttle opening. When the throttle is nearly open, maximum Mach Numbers may not be higher than 0.3, while the Mach Number range past the throttle plate will vary from Mach 1 to perhaps Mach 0.2 when the throttle is more nearly closed. Shaping the air throttle for Mach and Reynolds Number insensitivity is important for the practical performance of the present invention metering system. For conventional flat throttle plates, the variation of coefficient of discharge with Mach Number is around 30 percent and this variation entails an unacceptable 30 percent variation in air fuel ratio from the metering system.

FIG. 3 also shows an extremely inexpensive and exactly analytic system for enriching the mixture under conditions of very low manifold vacuum operation.

Connecting rod 98 has one end at the pressure of chamber 88, and the other end at the typically much lower pressure of chamber 49, so that a rightward error force is produced by con rod 98 equal to the cross sectional area of con rod 98 times the pressure difference between chambers 88 and 49. However, compensation rod 70 is also at the pressure of chamber 88, since it communicates with chamber 88 through passage 87. There is therefore a leftward force on compensation rod 70 equal to the cross sectional area of compensation rod 70 times the pressure difference between chamber 88 and chamber 64. The pressure differential between chamber 49 and chamber 64 is typically much smaller than the pressure differential between either chamber and chamber 88.

If the cross sectional areas of con rod 98 and compensating rod 70 were matched, these effects would cancel and the force on piston 95 would be very closely proportional to the pressure drop across orifice 48. However, if compensating rod 70 has larger diameter than connecting rod 98, as happens in FIG. 3, there is an extra leftward force due to the oversize of rod 70 and the relation between fuel ΔP and air ΔP becomes as follows: $\Delta P_f = K_1 P_{48} + K_2 P_{88}$ This means $\Delta P_f = K_3$ (Morifice 48)$^2 + K_2 P_{48}$ This relation is convenient, and provides an automatic enrichment of the mixture at very low intake manifold vacuums. When the Mach Number across the air throttle and across orifice 48 is large, the effect of con rod 70 oversize is negligible, but as velocities past the air throttle decrease, pressure drops across orifice 48 decline as the square, so that at low manifold vacuums the leftward force of con rod 70 becomes significant. It can be readily arranged for the sizing of con rod 98 and compensating rod 70 to be such as to produce significant enrichment only at very low intake manifold vacuums (for example one inch of mercury or less). The power enrichment function which occurs because of mismatch of diameters of rods 98 and 70 can be calculated exactly, and is inexpensive and convenient. For applications where an extremely flat air fuel ratio is desired over the full range of intake manifold vacuums it is of course desirable to match the diameters of rods 98 and 70. For such a system compensating needle 60 in orifice 48 would likewise be unnecessary.

FIG. 3 shows as many details of the present invention metering system as can be readily placed in one drawing. There are details which, because of graphics, were not shown. The pickup of upstream air at 46 and the passages feeding the air orifice 48 are too small, and the pickup at 46 will not pick up air at true upstream stagnation pressure. This imposes an error, but one skilled in fluid mechanics can readily design pickup analogous to 46 which does read approximately stagnation pressure upstream of the throttle plate. For many purposes, a pickup in the air cleaner passage (not shown) will read an excellent approximation of upstream stagnation pressure. In this case as in all others the difference between stagnation and static pressure becomes insignificant as velocities become very small. An analogous argument can be made with respect to errors in the pressure in chamber 100 due to the placement of pickup 104 in the fuel line. These errors can be very small indeed if the cross sectional area of passage 84 is very much larger than the flow cross sectional area of the fully opened slotted valve 80. Analogously, it is useful to have the cross sectional area in passage 86 very much larger than the maximum cross sectional area of a fully opened valve 80.

FIG. 4 shows a two orifice in series flow system which corresponds closely to that in a metering system developed by the inventors, and particularly shows orifice shapes having coefficients of discharge which are insensitive to either Reynolds Number or Mach Number change in the operating range of the system. Block 145 is provided with chamber 146, which has a very large cross sectional area with respect to orifice 148, which corresponds to orifice 48 in FIG. 3 and orifice 5 in FIG. 1. A control needle 160 partly blocks off the cross sectional area of orifice 148. Flow past orifice 148 flows into chamber 149, and it can be seen that the cross section directly downstream of orifice 148 expands very suddenly so as to essentially eliminate pressure recovery of the flow downstream of orifice 148. The smoothly convergent shape of orifice 148, with its large upstream passage and sudden expansion downstream produces an orifice which has a coefficient of discharge which is extremely constant so that the mass flow past orifice 148 obeys its theoretical flow equation to excellent accuracy. Orifice 148 is insensitive to Reynolds Number because the shape of orifice 148 constrains the flow streamlines in a pattern which is essentially invariant over the range of pressure drops relevant to orifice 148. The flow pattern downstream of orifice 148 is also effectively uniform over the range of flows relevant to the orifice. Chamber 149 is analogous to chamber 49 in FIG. 3 and passage 6 in FIG. 1. Chamber 149 is sufficiently large and sufficiently open so that the flow condition of the flow in the chamber as it approaches downstream orifice 150 is quite uniform. Orifice 150 is analogous to orifice 7 in FIG. 1, and connects chamber 149 with chamber 151, which chamber is connected so that it is at the static downstream pressure directly downstream of the air throttle. The curvature of orifice 150 is also such as to produce an extremely constant coefficient of discharge, and the cross sectional area of orifice 150 is controlled with control needle 152. Axial motion of either needle 160 or 152 will change the air fuel ratio of a metering system connected to the flow block of FIG. 4. It should be noted with respect to orifice 150 that the upstream flow is open and cleanly converging, and the flow from orifice 150 flows into a very expanded cross sectional area of chamber 151. Orifice 150 is designed to have a coefficient of discharge of nearly one, which means that the minimum cross sectional area of the flow streamlines occurs quite near the outlet plane of orifice 150 rather than farther downstream. Orifices with coefficients of discharge nearly one and no divergent sections are automatically insensitive to Mach Number, since compressibility effects cannot change the shape of their flow streamlines. The shape of orifice 150 should be carefully coordinated with the relatively narrow taper angle of needle 152 to assure that, for the range of needle axial position relevant to the system, the orifice 150 is always a convergent orifice, and never becomes a convergent divergent passage because of the interaction of the areas of the needle 152 and orifice 150. If orifice assembly 150–152 became convergent divergent, the flow of air past orifice 150 would depart appreciably from the compressible flow equation for which the metering system is designed. One can be assured of smooth convergence in a system such as orifice 150 with needle 152 if the minimum convergence angle of orifice 150 is the same as the apex angle of needle 152. The two orifice in series system of FIG. 4 has orifices which obey theoretical flow equations to an extremely high degree of accuracy.

The function of the metering system requires that the air throttle and fuel control valve be arranged so that the effective flow areas of the air throttle and fuel valve stay in a fixed and programmed proportion as the air and fuel valves open and close. FIGS. 5, 5A, and 5B illustrate how this is done, and show an arrangement where the projected open flow area of the fuel valve is proportional to the projected open area of the air throttle valve with both projected areas varying according to the simple trigonometric equation $$A_i = b_i(K - \cos\theta)\ K \leqq 1.$$

Referring to FIG. 5, a rectangularly slotted shaft 160 rides in a closely fitted receiver sleeve 162 having generally rectangular flow passages in it, and slotted shaft 160 is one part of the throttle shaft which also actuates the air throttle shown in phantom lines as 172. The flow in the fuel valve is from left to right, and surface 164 forms a smoothly convergent passage shape which will be characterized by exceptionally thin boundary layers because of the rapid change in static pressure of the flow streamlines as they flow towards the gap between plug slot in shaft 160 and bottom surface 166 of sleeve 162. The trigonometric relation of the opening gap area to twist angle $\theta$ is exactly proportional to the relation of the gap between throttle 172 and air passage surface 174 shown in phantom lines, and it is easy to arrange things so that the projected flow area of both valves varies in exact proportion. As has already been discussed, the shape of air throttle 172 is such that the coefficient of discharge of air throttle 172 is extremely insensitive to variations in Mach Number and Reynolds Number across this throttle. It is required that the coefficient of discharge as a function of shaft angle of the valve formed by 160 and 162 also be characterized by an insensitivity of coefficient of discharge to variations in pressure drop (and hence Reynolds Number) across this valve. Because the fuel flow valve handles an incompressible fluid, Mach number is not relevant, but Reynolds Number insensitivity matters.

The flow shaping details on the fuel valve required to achieve Reynolds Number insensitivity and also to program the coefficient of discharge of the fuel valve as a function of rotation to the desired relation with the air valve is shown in FIG. 5 with section FIG. 5A taken on section AA and FIG. 5B taken on section BB. FIG. 5A is a view from the inlet passage. Fuel from a relatively large inlet passage 179 flows into the generally rectangular passage of sleeve 162 through rounding entrance curvature 176, and flows through the rectangular passage until it contacts convergent surface 164, passing through the gap between surface 166 and 164 which forms the projected flow area of the valve. A number of issues illustrated in FIG. 5A are important. First of all, the relatively large area of the passage 179 is important. Because of this large area, velocities in passage 179 are small, and therefore the difference between stagnation pressures and static pressures shrinks to insignificance. The upstream pressure tap for the fuel regulator piston assembly, for example tap 104 in FIG. 3 should be in such a large section so that the pressure pickup will see pressure closely approximating stagnation pressure at surface 164. Another important issue is the rounded curvature of entrance surfaces 176, where the flow goes from the much larger passage to the rectangular slot leading to surface 164. When the fuel valve is operated at angles which are relatively closed, the pressure drop across this entrance section is relatively insignificant, but the pressure drop at the entrance surfaces 176 and directly downstream of them becomes quite significant as the valve opens. When the valve is in relatively open condition, it behaves as two orifices in series, the first being the fixed orifice formed by curved surfaces 176 and the second being the orifice formed for the gap between surface 166 and the end point of surface 164 on slotted shaft 160, By changing the curvature of curved surface 176, it is therefore possible to change the coefficient of discharge (and therefore the effective flow area) of the valve of FIG. 5 as a function of shaft rotation. This must be done empirically, but it is relatively convenient to shape the rounded surfaces of 176 in such a way that the coefficient of discharge of the fuel valve and the air throttle match closely at all values of shaft angle. In the mathematical write-up which follows the point is made that variations for pressre tap position and other problems may be compensated by changing the ratio of coefficient of discharge between the air valve and fuel valve in a controlled way as a function of shaft angle. It is by changing the curvature of surfaces 176 that this way be most conveniently accomplished.

Reynolds Number insensitivity of the fuel valve also requires that the flow conditions downstream of the valve be properly controlled. FIGS. 5B in combination with FIG. 5 shows how this can be done conveniently. As slotted shaft 160 rotates counterclockwise in FIG. 5 the fuel valve opens and there is a gap between surface 166 and surface 164 through which fuel passes. The high velocity fuel through this gap rushes downstream, and it is desirable to dissipate the velocity of this flow into turbulence with minimum pressure recovery if the fuel valve is to show optimal Reynolds Number insensitivity. For small values of throttle opening this is almost automatic but the problem becomes more difficult as the throttle valves open. Reynolds Number insensitivity, and minimum pressure recovery, are achieved by the most sudden convenient expansion of the fuel in the downstream section, and by arranging flow patterns to prevent wall attached streams from forming. Coanda wall attached streams should be avoided since such attached streams are conducive to larger values of pressure recovery than otherwise occur downstream of the fuel valve. Downstream of surface 166 is cutaway surface 170 which assures that the high velocity flow stream cannot attach to the lower wall of the downstream passage. The high velocity jet from the fuel valve expands rapidly, and the passage from the rectangular passage 184 to open passage 186 is also an abrupt opening conducive to small or zero pressre recovery. In order to reduce pressure recovery further, it is desirable that the axial width of passage 184 be increased beyond that shown in the drawing, although this is usually not necessary for ordinary system accuracy. With the sudden expansions, the fluid pressure in large passage 186 becomes very close to the vena contracta static pressure for which the fuel flow equation is exactly defined. This minimal pressure recovery is convenient from a control point of view, because it permits the entire fuel flow past the fuel valve to be used as the pressure regulating pressure reference flow. Referring to FIG. 3 for context, the pressure in passage 88 and directly upstream of piston valve 95 will be very close to the static vena contracta pressure downstream of the fuel valve. The advantage of this will be clarified in the following mathematical write-up. In summary, FIGS. 5, 5A and 5B show a fuel valve with a projected open area which varies in precise proportion with the projected open area of the air throttle valve, the fuel valve is built for an extremely constant coefficient of discharge over the range of Reynolds Numbers across which it must operate, and the shaping of curvatures 176 in the valve permits the coefficient of discharge of the fuel valve in relation to the air valve to be programmed as any desirable function of shaft angle $\theta$.

In FIGS. 3 and 5 side views of Mach Number insensitive rectangular air throttle have been shown. FIG. 6 shows a view of the downstream side of the throttle plate of FIG. 3, showing a notched section for the idle air flow of the system. Throttle 42 is adapted to pivot on a shaft fitting through hole 192, shown in dashed lines. As the throttle pivots open, the open area between edge 194 and the left side of the rectangular passage in which the air throttle pivots opens for air flow. When the throttle is fully closed, there is still need for a minimum idle air flow and this idle flow passes through notch 195, which is adapted to produce a stable wall attached stream air flow downstream of the notch. This high speed stream is useful for downstream mixing purposes.

FIG. 7 is a view of the fuel input passage shown at 111 and 112 of FIG. 3, showing how the axial distribution of fuel into the high speed air stream past the air throttle is achieved, and how this distribution varies as the throttle shaft rotates. It is well to look first at FIG. 3 to see the fuel introduction ports at 111 and the passage 112, both in the vicinity of the opening edge of air throttle 42. FIG. 7 shows an axial cut-away of this passage. The passage is characterized by a multiplicity of holes, 111, 200, 201, 202, 203, 204 and 205. When the throttle is fully closed and only the idle flow is passing, only hole 111 is open, and fuel from metering passage 110, shown in FIG. 3, feeds directly to hole 111. Under this idle condition fuel is therefore introduced to the very high velocity air stream past the idle slot for distribution and atomization. Under these conditions air flows through holes 200, 201, 202, 203, 204, 205 of passage 112 so that the flow past hole 111 is a mixture of fuel and air. Covering each of holes 200–205 is laminar resstance material (which can be either of paper or of finely woven mesh) 206, which serves as a laminar resistance element for flow past holes 200 to 205. As the throttle rotates to open position, (depicted diagramatically by dashed lines 195, 194 in FIG. 7) the throttle first uncovers hole 200 then hole 201 then hole 202 then hole 203 then 204 and finally 205, so that after the throttle is part way open fuel is being distributed evenly along the axial length of throttle 42, for even introduction to the downstream passage 40 and to the engine. This smooth axial distribution of fuel into the air stream is convenient for mixing arrangements downstream of air throttle 42.

FIG. 8 is analogous to FIG. 4, but shows an upstream orifice arrangement designed to produce 50 percent pressure recovery downstream of the upstream orifice. By taking the pressure drop across the diaphragm or piston arrangement to be equal to the maximum pressure drop across this upstream orifice but having pressure recovery prior to the downstream orifice this flow arrangement eliminates compressibility effects which would otherwise slightly degrade the accuracy of the metering system. Referring to FIG. 8, chamber 245 is linked by passage 280 with the upstream pressure side 282 of a diaphragm assembly 270 used in the metering system control assembly, and the pressure in chamber 245 is approximately stagnation pressure upstream of the air throttle. Flow from chamber 245 passes through smoothly convergent nozzle 248, where the flow passes into cylindrical passage 253. The ratio of orifice minimum cross sectional diameter to the diameter of cylinder 253 is equal to 0.62, which is a value taken from *Fluid Meters*, sixth edition, 1971, the American Society of Mechanical Engineers, New York, N.Y., Page 221, the value being chosen to produce 50 percent pressure recovery. Directly downstream of nozzle 248 is pressure tap 246, which connects to the low stream pressure side 284 of the diaphragm, shown schematically as assembly 270. Flow from cylindrical passage 253 proceeds to open chamber 249, which feeds downstream orifice 250. Flow past orifice 250 expands to passage 251, which is strictly analogous to passage 151 in FIG. 4, and passage 251 is at the vena contracta static pressure downstream of the air throttle. The flow arrangement of FIG. 8 has mathematical advantages with respect to accuracy which will be discussed in the mathematical write-up, but this advantage is purchased at the cost of having orifice 248 a fixed orifice without a variable control needle, so that a system which would otherwise have two control needles must work with only one if the flow arrangement of FIG. 8 is to be used.

The design issues addressed in FIGS. 1–8 involve a good deal of attention to fluid mechanical details which permit the metering system to operate as a precision instrument. In addition, the precision of the metering system rests on the exactness of basic laws of fluid mechanics. FIG. 9 shows the most important compressible flow relations, plotting particularly the mass flow per unit area versus the mass flow per unit area which would occur at sonic velocity as a function of pressure drop across a perfect orifice. The flow relations in FIG. 9 are near exact, although the dimensional model ignores boundary layers and dimensional effects. The mathematical relations are used with precision in the two orifice in series passage and for the flow characteristics past the air throttle valve. FIG. 9 is copied from Page 197 of *The Internal Combustion Engine in Theory and Practice*, Volume 2, by Charles Fayette Taylor, MIT Press, copyright 1968. The horizontal axis of FIG. 9 is plotted in terms of two inversely related variables, the first being % $\Delta P$ across the orifice, and the second being the pressure ratio across the orifice. The vertical axis plots two important functions, the first $\dot{M}/\dot{M}^*$ shows the ratio of mass flow to mass flow at sonic velocity which happens at various pressure drops. It is notable that 50 percent of the mass flow which would occur at sonic velocity already occurs at a pressure drop of 6 percent. Also plotted is the compressibility function $\Phi_2$. Reference to FIG. 9 may be useful on a number of occasions when considering the mathematical analysis of the metering system, and evaluating its precision.

In the drawings, it has been shown how to produce metering elements which obey the governing inviscid flow equations to extremely high accuracy. Referring to generally schematic drawings 1 and 2, it has been shown how to produce an air throttle valve with a coefficient of discharge as a function of throttle rotation which is very insensitive to variations in pressure drop across the throttle, so that flow across the throttle can be described by the simple isentropic flow equation. It has been shown how to build an upstream orifice analogous to orifice 5 of FIG. 1 which is characterized by a coefficient of discharge which is Reynolds number insensitive so that the flow equation across orifice 5 can be characterized by the simple isentropic flow equation.

It has been shown how to produce a downstream orifice analogous to orifice 7 of FIG. 1 which has a coefficient of discharge insensitive to pressure drops across it, so that flow past orifice 7 can be characterized by a simple and exact isentropic flow equation. On the fuel side, it has been shown how to build a fuel valve with an effective flow area varying in precise and programmed relation to the effective flow area of the air valve, and how to make this fuel valve so that its coefficient of discharge at each value of throttle rotation is insensitive to the variations in Reynolds Number which occur in its operating range. Therefore the fuel valve flow characteristic can be defined by a straightforward and exact incompressible flow equation. It has been shown how to produce a control of the pressure drop across the variable fuel valve which varies in precise and calculable relation with the pressure drop of an upstream orifice analogous to orifice 5. The reason for showing these things was to build a system which was precisely describable by exact equations.

At Southwest Research Institute we have built a fuel air metering system with fluid mechanical details closely following the details of the drawings. We have found that the measured flows in the system follow the flows of the theoretical equations to high accuracy, to the point where it is often impossible to detect deviations between theory and experiment because of the resolution limits of our (carefully made) experimental equipment.

The following analysis makes clear the rational mathematical basis of the present invention metering system. The analysis involves many equations, but the accuracy with which the metering system components fit the equations is so high that the analysis is quite reliable. The notation and analysis is done in close analogy with the analysis of "Carburetor Flow Equations" on Pages 195 and 199 of *The Internal Combustion Engine in Theory and Practice,* Volume 2, by Charles Fayette Taylor, MIT Press, copyright 1968. The following analysis offers an excellent base for design of our fuel air metering system. The analysis is also very useful as a guide to trouble shooting if a metering system according to the present invention departs from the predicted equations. By using these equations, the source of the trouble can be quickly identified, and solutions to the trouble generally suggest themselves rapidly. The analysis has the following list of variables, which correspond closely to those in Professor Taylor's book:

LIST OF VARIABLES $\dot{M}_a$ = massflow rate of air
$\dot{M}_f$ = massflow rate of fuel
IMV = intake manifold vacuum
T = temperature
$P_{atm}$ = atmospheric pressure
$\theta$ = throttle angle
$A_i$ = valve area
$A_f$ = fuel valve area
$A_a$ = air throttle area
$C_i$ = valve discharge coefficient
$[A_aC_a]$, $[A_fC_f]$ = effective valve flow area at a specific valve opening angle $A_i$ $C_i$ is a function of throttle angle, $\theta$.
$\Delta P_f$ = fuel pressure differential across fuel valve equals stagnation pressure upstream of valve minus static downstream of valve).
$\Delta P_a$ = air pressure differential across air throttle valve (P stagnation upstream − P static downstream) = $\Delta P_a$
r = P downstream/P upstream = $(1-\Delta P_a/\text{P upstream})$
$\Phi = 1.87\,(r)^{0.715}\sqrt{1-r^{0.286}}/1-r$
$\Phi$ is a compressibility function which constitutes the difference between the air flow function and the fuel flow function.
$\rho$ = density of air at standard sea level conditions
$\sigma = p_{oi}/\rho$ ratio of stagnation density upstream air throttle to standard sea level density
$O_u$ = upstream orifice of two orifice in series airflow analogy system
$O_d$ = downstream orifice of two orifice in series airflow analogy system
n = area $O_u$/area $O_d$ ratio of upstream to downstream areas in the analogy passage.

The objective of a fuel-air metering system is to control air/fuel ratios as a function of engine control variables. In notation:

$$\dot{M}_a/\dot{M}_f = f(\theta, IMV, T, P_{atm} \ldots) \quad ①$$

To start the analysis, consider a constant air/fuel ratio:

$$\dot{M}_a/\dot{M}_f = K_1. \quad ②$$

Bernoulli's equation (the incompressible flow equation) is $$\dot{M}_f = A_fC_f\sqrt{2g\rho_f\Delta P_f}. \quad ③$$

The mass flow equation for a compressible fluid like air is $$\dot{M}_a = \Phi_2 A_aC_a\sqrt{2g\sigma\rho(\Delta P_a)}. \quad ④$$

To get $\dot{M}_a/\dot{M}_f = K_1$ implies $$\frac{\dot{M}_a}{\dot{M}_f} = \frac{[A_a\,C_a]\left[\Phi_2\sqrt{\sigma}\right]\left[\sqrt{2g\,\rho}\right]\sqrt{\Delta P_a}}{[A_f\,C_f]\left(\sqrt{2g\,\rho_f}\right)\sqrt{\Delta P_f}}. \quad ⑤$$

Since the groups $(\sqrt{2g\rho})$ and $(\sqrt{2g\rho_f})$ are essentially constant, let $K_3 = \sqrt{2g\rho/2g\rho_f} = \sqrt{\rho/\rho_f}$. Equation ⑤ then becomes $$\frac{\dot{M}_a}{\dot{M}_f} = \frac{K_3\,[A_a\,C_a]\left[\Phi_2\sqrt{\sigma}\right]\sqrt{\Delta P_a}}{[A_f\,C_f]\sqrt{\Delta P_f}}. \quad ⑥$$

The linked air throttle and fuel valve arrangement shown in FIGS. 5, 5A and 5B is one of many possible arrangements where the fuel metering orifice effective area and the air metering orifice effective area vary in proportion to each other. For an exact proportionality, the notation is $$A_aC_a/A_fC_f = K_4 \text{ this means } A_aC_a = K_4A_fC_f. \quad ⑦$$

In the case shown in the drawings, both $A_aC_a$ and $A_fC_f$ vary with rotation angle $\theta$ of a shaft $A_aC_a(\theta)/A_fC_f(\theta) = K_4$.

Algebraically substituting ② and ⑦ into ⑥ yields $$K_1 = K_3K_4(\Phi_2\sqrt{\sigma})\sqrt{\Delta P_a}/\sqrt{\Delta P_f}. \quad ⑧$$

Rearranging (8) yields the following convenient form $$(K_1/K_3K_4)\sqrt{\Delta P_f}=(\Phi_2\sqrt{\sigma})\sqrt{\Delta P_a}. \quad (9)$$

Both sides of Equation (9) are proportional to the massflow of air per unit of effective air flow orifice area. Squaring both sides of equation (9) gives $$(K_1/K_3K_4)^2\Delta P_f=[(\Phi_2\sqrt{\sigma})\sqrt{\Delta P_a}]^2 \quad (10)$$

In words, Equation (10) says that to get a constant air/fuel ratio from a metering system having a constant ratio of effective orifice areas between its fuel metering orifice and its air metering orifice, it is both necessary and sufficient that the pressure drop across the fuel metering orifice, $\Delta P_f$, be regulated in proportion to the square of the massflow per unit effective area past the airflow orifice.

Equation (10) should look familiar to anyone who knows carburetors, since a venturi metering system has the suction of fuel into the airstream, $\Delta P_{fv}$, proportional to the square of massflow of air $M_{av}$ divided by $\Phi_2$, with $\Phi_2$ a slowly moving function if the air venturi is large in relation to the air throttle opening.

$$\text{Venturi equation: } \Delta P_{fv}=K_v(\dot{M}_{av})^2/\Phi_2$$

With a simple venturi system, both $A_{av}C_{av}$ and $A_{fv}C_{fv}$ are fixed, so that $A_{av}C_{av}/A_{fv}C_{fv}$ are in constant ratio, in analogy with the requirements of equation (10). However, the present invention metering approach has the airflow metering orifice and the fuel flow metering orifice *each varying as engine load is varied*, with the ratio $A_aC_a/A_fC_f$ held constant.

The practical advantage of this variation is very great. Consider a venturi carburetor: if the butterfly throttle valve opening varies over a factor of (10), with engine load controlled so the pressure drop across the butterfly is maintained constant, $\Delta P_{fv}$ will vary by about a factor of 100 (exactly a factor of 100 if $M_a/M_f=K$ is to be maintained).

Because the pressure drop across the butterfly is unchanged, the massflow of air per unit effective butterfly valve opening area is unchanged, but a 100 fold pressure drop variation has occured in the venturi. With a system according to the current invention, the fuel flow metering orifice would vary in proportion to the butterfly airflow orifice, and the metering pressure drop across the fuel metering valve, $\Delta P_f$, would not have to change at all. The lower variation of $\Delta P_f$ with the current invention is an important practical advantage, because it holds the $\Delta P_f$ range within reasonable limits.

Fuel-air metering systems for automobiles operate over a 30:1 to 50:1 range of massflows. For a venturi this involves $\Delta P_{fv}$ ranges between 900:1 and 2500:1. Accurate fuel metering over this vast pressure range is never practical, so the carburetor requires separate idle systems, transition systems, and full power systems, and there are metering problems as these systems turn on or off. For a system where $KA_fC_f=A_aC_c$, the pressure range required for fuel metering is much less, by the ratio $(A_aC_{a\,max}/A_aC_{a\,min})^2$. As intake manifold vacuum changes from 20" Hg to 1" Hg, there is less than a factor of 3 change in massflow per unit effective butterfly valve area, so that less than a 9-fold variation in $\Delta P_f$ is required. This smaller range is a much more practical range of $\Delta P_f$ to build hardware for, and it is therefore possible to build a metering system which involves only one basic fuel metering circuit to handle the entire flow range of engine requirements. The present invention also has the practical advantage that $\Delta P_f$ varies roughly with intake manifold vacuum, and so is conveniently large under the low load conditions where auto engines operate most of the time. For a venturi system,, $\Delta P_{fv}$ is very small under these same low load conditions, making precise fuel-air metering at low loads very difficult with a carburetor.

To control fuel-air metering so that $\dot{M}_a/\dot{M}_f=K$ with a system having $A_aC_a=K\ A_fC_f$ requires that $\Delta P_f$ be regulated so that Equation (10) is satisfied.

To satisfy Equation (10) the pressure drop across the variable fuel valve, $\Delta P_f$, must be varied in proportion to the square of the massflow of air per unit effective open area past the air throttle valve. In the present invention this is done by producing a signal which varies in proportion to $[(\Phi_2\sqrt{\sigma})\sqrt{\Delta P_a}]^2$ with a specially designed two orifice in series bypass system, and controlling $\Delta P_f$ in exact proportion to that signal with a regulator arrangement. This regulator system will require some detailed discussion, but at this point assume a regulator is available such that $\Delta P_f$ varies in exact proportion to pressure drop across an air diaphragm $$\Delta P_f=K_5\Delta P_{diaphragm}. \quad (11)$$

The diaphragm can have one side connected to a chamber located between the two orifices, with the downstream orifice $O_d$ connecting the chamber to static pressure downstream the air throttle and the upstream orifice $O_u$ connecting the chamber with the stagnation pressure upstream of the air throttle valve. On the other side of the diaphragm is the stagnation pressure upstream of the air throttle. With this arrangement, the pressure drop across the diaphragm is equal to the pressure drop across the upstream orifice $O_u$, $$\Delta P_{diaphragm}=\Delta P_{O_u}. \quad (12)$$

Orifices $O_u$ and $O_d$ are in series, and therefore, instantaneous massflow rates past the two orifices must match at equilibrium:

$$\dot{M}_{O_u}=\dot{M}_{O_d}. \quad (13)$$

Flows past $O_u$ and $O_d$ each follow Equation (4)

$$\dot{M}_a=\Phi_2A_aC_a\sqrt{2g\sigma\rho\Delta P_a}. \quad (4)$$

Rewriting, with the relevant subscripts for each orifice, the massflow equations are:

$$\dot{M}_{O_u}=\Phi_{2O_u}A_{O_u}C_{O_u}\sqrt{2g\sigma_{O_u}\rho\Delta P_{O_u}}=\dot{M}_{O_d}=\Phi_{O_d}A_{O_d}C_{O_d}\sqrt{2g\sigma_{O_d}\rho\Delta P_{O_d}}. \quad (14)$$

Compressibility effects exist for flow past both these orifices, but the importance of compressibility effects varies greatly with the magnitude of the $\Delta P$ across the orifice. For very small pressure drops the compressibility effects are so small that the flow equation for air approximates the incompressible flow equation which governs the fuel flow. If the area of upstream orifice $O_u$ is much larger than the area of downstream orifice $O_d$, the great majority of the pressure drop across the system occurs across orifice $O_d$. For example, if $$A_{Ou}C_{Ou}=5A_{Od}C_{Od} \quad (15)$$

the pressure drop across $O_u$ is about 1% of total pressure at maximum, when the pressure drop across $O_d$ is sonic (choked flow). It will be shown that this produces to excellent approximation the pressure relations required to regulate $\Delta P_f$ to achieve Equation (10).

With $A_{Ou}C_{Ou}/A_{Od}C_{Od}=5$, the flow per unit area past $O_d$ is very nearly equal to the flow per unit area past the air throttle (butterfly valve), since the pressure drop across $O_d$ is very close to the pressure drop across the air metering valve and $$\lim_{\Delta P_1 \to \Delta P_2} \frac{\Phi_{2\Delta P_1}\sqrt{2g\,\sigma_{\Delta P_1}\,\rho\,(\Delta P_{\Delta P_1})}}{\Phi_{2\Delta P_2}\sqrt{2g\,\sigma_{\Delta P_2}\,\rho\,(\Delta P_{\Delta P_2})}} = 1 \quad (16)$$

it is therefore a good approximation (the exactness of which will be shown below) to say that flow past $O_d$ is proportional to flow per unit effective area of the air throttle.

$$\dot{M}_{Od}=K_6\Phi_2\sqrt{\sigma}\sqrt{\Delta P_a}. \quad (17)$$

Since the pressure drop across $O_u$ is at maximum about 1%, Equation (4) for orifice $O_u$ is, to good approximation $$\dot{M}_{Ou}=K_7\sqrt{\Delta P_{Ou}} \quad (18)$$

solving for $\Delta P_{Ou}$ $$\Delta P_{Ou}=(\dot{M}_{Ou}/K_7)^2=K_8(\dot{M}_{Ou})^2 \quad (19)$$

but $\dot{M}_{Ou}=\dot{M}_{Od}$ so $$\Delta P_{Ou}=K_8\dot{M}_{Od}^2. \quad (20)$$

Algebraically substituting Equations (11) and (12) and (17) into $$\Delta P_{Ou}=\Delta P_d=\Delta P_f/K_5=K_8[K_6\Phi_2\sqrt{\sigma}\sqrt{\Delta P_a}]^2 \quad (20)$$

yields $$\Delta P_f=K_5K_8K_6^2[\Phi_2\sqrt{\sigma}\sqrt{\Delta P_a}]^2. \quad (21)$$

Arranging constants $(K_3K_4/K_1)^2=K_5K_8K_6^2$ yields equation (10)

$$(K_1/K_3K_4)^2\Delta P_f=[\Phi_2\sqrt{\sigma}\sqrt{\Delta P_a}]^2 \quad (10)$$

Satisfaction of Equation (10) satisfies the requirements for $$\dot{M}_a/\dot{M}_f=K \quad (2)$$

the required constant air/fuel ratio.

A vital part of the preceding mathematical argument is that the two orifice in series systems involving $O_d$ and $O_u$ forms a flow analogy which satisfies the flow equation $$\Delta P_{Ou}=K_{11}[\Phi_{2a}\sqrt{\sigma_a}\sqrt{\Delta P_a}]^2 \quad (25)$$

to a high degree of accuracy. Since $\Delta P_f$ is controlled by a regulator to be proportional to $\Delta P_{Ou}$ this satisfies Equation (10).

The two orifice in series analogy is a very good one, and the departure of the analogy from perfection can be calculated exactly (assuming that the pressure downstream of $O_d$ and the pressure upstream of $O_u$ exactly correspond to the upstream stagnation and downstream static pressures of the air flow throttle valve, a matter which will be dealt with later).

For very small pressure drops across the system, the compressible flow equation reduces to the incompressible flow equation $$\lim_{\Delta P\to 0}\Phi_2AC\sqrt{2g\sigma\rho\Delta P} = AC\sqrt{2g\rho_a\Delta P} \quad (26)$$

where $\rho_a=\sigma\rho$ = upstream air density. For the very low $\Delta P_a$ case, the flow analogy is essentially perfect, as the following algebra shows if $A_{Ou}C_{Ou}=nA_{Od}C_{Od}$.

$$\dot{M}_{Od}=\dot{M}_{Ou}=A_{Ou}C_{Ou}\sqrt{2g\rho_a\Delta P_{Ou}} = nA_{Od}C_{Od}\sqrt{2g\rho_a\Delta P_{Ou}} = A_{Od}C_{Od}\sqrt{2g\rho_a\Delta P_{Od}} \quad (27)$$

$$\Delta P_{Od}=n^2\Delta P_{Ou} \quad (28)$$

Since $\Delta P_a=\Delta P_{Od}+\Delta P_{Ou}$, $$\Delta P_a=(n^2+1)\Delta P_{Ou}, \quad (29)$$

$$\Delta P_{Od}=(n^2/(n^2+1))\Delta P_a \quad (30)$$

$$\Delta P_{Ou}=(1/(n^2+1))\Delta P_a \Delta P_{Od}\propto\Delta P_a\propto P_{Ou}, \quad (31)$$

and so $\sqrt{\Delta P_{Od}}\propto\sqrt{\Delta P_a}\propto\sqrt{\Delta P_{Ou}}$ and so the analogy is perfect in the low $\Delta P_a$ limiting case.

For the maximum $\Delta P_a$ case the analogy is imperfect, but the analogy is still a good one with errors which can be exactly calculated. For large $\Delta P_a$, flow past orifice $O_d$ is sonic. Sonic velocity is proportional to $\sqrt{T_{absolute}}$ for a near perfect gas like air. For air, the Joule-Thompson coefficient is such that the temperature change due to throttling is negligibly small for the small $\Delta P$ past $O_u$. Therefore, at choked flow for $O_d$ the following equation holds (unless there is heat transfer within the two orifice in series bypass system.

$$\dot{M}_{Od}=A_{Od}((P_{atm}-\Delta P_{Ou})/P_{atm})\rho V \text{ sonic} \quad (32)$$

if $\Delta P_{Oumax}=0.01$ atm then $r_{Oumax}=0.99$ if r is defined as $r=(P_{atm}-\Delta P_{Ou})/P_{atm}$.

At sonic flow past $O_d$, $\dot{M}_{Od}$ is exactly proportional to $r_{Oumax}$ so a x% pressure drop in $O_u$ produces an x% reduction in $\dot{M}_{Od}$ under choked (sonic flow) conditions.

However, this x% error is cut in half because of compressibility effects in orifice $O_u$, as shown below.

$$M_{Ou}=\Phi_2A_{Ou}C_{Ou}\sqrt{2g\sigma\rho\Delta P_{Ou}}.$$

With good design $A_{Ou}C_{Ou}$ is really constant and 2 g $\sigma$ $\rho$ is constant for $O_u$ in the range of pressure drops relevant to $O_u$. An excellent approximation is:

$$\Phi_2\cong\sqrt{r} \quad (22)$$

for small $\Delta P$ where $r=(P_{atm}-\Delta P_{Ou})/P_{atm}$. The excellence of approximation (22) is shown as follows:

| r | $\frac{r}{\Phi_2}$ |
|---|---|
| .950 | 1.001870 |
| .980 | 1.000687 |
| .990 | 1.000314 |
| .995 | 1.000021 |

$$\Phi_2 = 1.87\,(r)^{0.715}\sqrt{\frac{1-r^{0.286}}{1-r}}$$

The approximation greatly simplifies the algebra of the analysis, and permits us to say that $$\dot{M}_{Ou} \propto \sqrt{r_{Oumax}}\sqrt{\Delta P_{Ou}}.$$

Since $\dot{M}_{Ou}=\dot{M}_{Od}$, for choked flow conditions past $O_d$ we have $$\dot{M}_{Od} \propto r_{Oumax} \propto \sqrt{r_{Oumax}}\sqrt{\Delta P_{Ou}}$$

so $$\sqrt{\Delta P_{Ou}} \propto (\dot{M}_{Od}/\sqrt{r_{Oumax}}) \propto (r_{Oumax}/\sqrt{r_{Oumax}}), = \sqrt{r_{Oumax}}.$$

This means that an n% $\Delta P_{Ou}$ introduces an error at choked flow conditions of ½n%. Evaluation of two orifice in series flow system at $r_a$'s between choked pressure drops and very small pressure drops shows that the error function varies smoothly, and in an exactly calculable way, between the very low pressure drop and choked flow extremes. Therefore, if $\Delta P_{Oumax}$ is 1% of total pressure, the error in fuel-air metering due to the two orifice in series analogy will be less than or equal to ½% for all $\Delta P_a$ values. The analogy of two orifices in series does an inherently good job of satisfying Equation (10).

It can be shown that the variation of $\dot{M}_a/\dot{M}_f$ with $\Delta P_a$ (intake manifold vacuum) can be exactly filtered out if the upstream orifice $O_u$ is an orifice option with $\Delta P_{Ou}$ being the static pressure in the orifice and with a diffuser section yielding exactly 50% pressure recovery. FIG. 8 shows such a system. This is a significant potential advantage, since it offers the opportunity of a $\Delta P_{Ou}$ signal significantly large without degradation of the signal analogy. Provision of a pressure recovery passage with the upstream orifice presents problems with respect to programming the variation of air/fuel ratio as a function of engine variables because a needle cannot be used to vary the area $O_d$ without changing pressure recovery. Even without pressure recovery from the upstream orifice, the two orifice in series system produces an excellent pressure signal, $\Delta P_{Ou}$, for controlling the fuel regulation system.

In addition to inherent mathematical imperfections of the analogy system, real analogy systems have practical problems because of the problems associated with pressure taps.

The requirement that pressure downstream of $O_d$ and pressure upstream of $O_u$ exactly correspond to the proper stagnation pressure upstream and static pressure downstream of air controller butterfly valve for all values of valve shaft $\theta$ is hard to meet. For a set $\theta$, errors due to connection placements upstream and downstream of the two orifice in series analogy system can be compensated to a high degree of exactness by compensatory changes in coefficients of discharge. (The exactness of this compensation can be very good for this butterfly valve system, since for normal engine operation the range of Reynolds numbers is only about 4:1 and Reynolds numbers are very high in any case, so long as periodic flow mode shifts, for example large scale vortex growth and shedding, are guarded against.)

Therefore, because of imperfections in the flow connections (pressure pickups) the ratio $\dot{M}_a/\dot{M}_f$ will vary as a function of airflow valve shaft angle. In the high Reynolds number limit, typical of this system, $$\dot{M}_a/\dot{M}_f \propto h(\theta) \text{ without compensation} \quad (33)$$

wherein $h(\theta)$ is an error function which may be quite small if enough care is taken with airflow pickup positions. Error function $h(\theta)$ can be compensated out by changing Equation $$A_aC_a/A_fC_f=K \quad (7)$$

to $$A_aC_a/A_fC_f=K/h(\theta) \quad (7a)$$

An exactly symmetrical argument to the argument leading to Equation (7a) can be made concerning the pressure pickups for the fuel pressure regulation system which is required to make (11) $P_f=K_5\,\Delta P_{diaphragm}$ true. Again, the flow connections in the fuel system may not pick up true upstream stagnation pressures and probably will not pick up true downstream static vena contracta pressures. Imperfections in the fuel pressure pickups will introduce errors so that, even with (7a) satisfied, there will be an error function which can be expressed, since the fuel valve and the air valve are linked, as $$\dot{M}_a/\dot{M}_f=i(\theta).$$

The proper compensation to achieve $A_aC_a/A_fC_f=K_4$, therefore, is $$A_aC_a/A_fC_f=K_4/h(\theta)i(\theta). \quad (7b)$$

This condition (7b) can be satisfied by controlling the shape of convergent surfaces 17*b* shown in FIGS. 5 and 5A. This shaping is straightforward, and must be done empirically for each metering system design.

So far, the problem of designing a metering system having constant air/fuel ratio has been discussed.

$$\dot{M}_a/\dot{M}_f=K \quad (2)$$

However, in general it is desired to vary air/fuel ratio as some specified function of engine operating variables. In general $$\dot{M}_a/\dot{M}_f=f(\theta, \text{IMV}, \text{T}, \text{P}_{atm}, \ldots) \quad (1)$$

to vary $\dot{M}_a/\dot{M}_f$ in programmed relation to engine variables can be readily done by varying the ratio of areas of the two orifice in series system $A_{Ou}C_{Ou}/A_{Od}C_{Od}=n$.

It can be shown that, for airflows past the air throttle much larger than the airflow past the analogy system, $\dot{M}_a/\dot{M}_f$ varies approximately in proportion to n. For exact fuel-air metering requirements it is worthwhile to define the exact relation between $\dot{M}_a/\dot{M}_f$ and the sizes of orifices $O_u$ and $O_d$.

A great simplification in the analysis is possible if the airflow past orifice $O_d$ is lumped together with the airflow past the air throttle valve per se, so that $$A_aC_a(\theta)_{total}=A_aC_a(\theta)_{throttle}+K_gA_{Od}C_{Od}$$

where $K_g=r_{Oumax}$. The error involved in this simplification is small. For example, if $r_{Oumax}=0.98$ and $A_{Od}C_{Od}$ equal to 25% of the idle airflow, the error due to lumping the flows together is ¼% at idle and this error declines inversely with $\dot{M}_a$, becoming insignificant as the throttle opens.

Using this approximation it can be shown that air/fuel ratio, $\dot{M}_a/\dot{M}_f$ varies exactly in proportion to n when $\Delta P_{Od}$ and $\Delta P_a$ are small (the condition which occurs at relatively wide open throttle operating conditions).

The algebra for this low $\Delta P_{Od}$ case is as follows.

For low $\Delta P_{Od}$, flows are nearly incompressible so $$\Delta P_{Od}=n^2\Delta P_{Ou}.$$

Since $\Delta P_a=\Delta P_{Ou}+\Delta P_{Od}$ $$\Delta P_{Ou}=(1/(n^2+1))\Delta P_a$$

$$\Delta P_{Od}=(n^2/(1+n^2))\Delta P_a.$$

The fuel regulator operates such that $\Delta P_f=K\Delta P_{Ou}$.

$$\Delta P_{Ou}=\Delta P_{Od}/n^2$$

is the low $\Delta P_{Od}$ case. The fuel flow equation is $$\dot{M}_f=[A_fC_f(\theta)]\sqrt{2g\rho_f(K_5(\Delta P_{Od}/n^2))}.$$

In this equation, holding everything but n constant, $\dot{M}_f$ is exactly proportional to 1/n, which shows that for the low $\Delta P_{Od}$ case $\dot{M}_a/\dot{M}_f$ is exactly proportional to n.

When $\Delta P_{Od}$ becomes large enough for important compressibility effects, $\dot{M}_a/\dot{M}_f$ is no longer exactly proportional to n, but the approximate proportionality remains, and the exact proportionality can be calculated exactly. It has already been shown how to derive this error function implicity. For any value of $n=A_{Ou}C_{Ou}/A_{Od}C_{Od}$ there exists a $\Delta P_{Oumax}$ which occurs when $\Delta P_a$ and $\Delta P_{Od}$ are large enough to produce sonic flow past orifice $O_d$. If $\Delta P_{Ou}$ is an x% pressure drop, the system produces a ½x% reduction in $\dot{M}_{Od}$ and hence a ½x% increase in $\dot{M}_a/\dot{M}_f$ over the $\dot{M}_a/\dot{M}_f$ value for set n. Accounting for compressibility effects, therefore $$\dot{M}_a/\dot{M}_f=Kn((P_s-\tfrac{1}{2}\Delta P_{Oumax})/P_s) \quad (34)$$

where $P_s$ is stagnation pressure upstream of the air throttle.

For values of $\Delta P_{Ou}$ less than $\Delta P_{Oumax}$ Equation (34) is still very nearly exact. For practical systems requiring precision it is easy to hold $$((P_s-\tfrac{1}{2}P_{Ou})/P_s)\geqq 0.95,$$

so the proportionality between n and $\dot{M}_a/\dot{M}_f$ is a good one.

The foregoing analysis is very good if $n=A_{Ou}C_{Ou}/A_{Od}C_{Od}$ is varied by changes in $A_{Ou}C_{Ou}$, since changing the upstream orifice has almost no effect on airflow past the downstream orifice. Changing the area of the downstream orifice does effect the value of airflow into the system, and the effect of this can be computed exactly by any skilled engineer who has followed the foregoing analysis. The effect of changes in downstream orifice area, $A_{Od}C_{Od}$, is most important near idle airflows.

It has been shown that air/fuel ratio, $\dot{M}_a/\dot{M}_f$, varies directly with the effective area of orifice $O_u$, $A_{Ou}C_{Ou}$, and varies approximately inversely with the effective area of $O_d$ $A_{Od}C_{Od}$. Control of $\dot{M}_a/\dot{M}_f$, therefore, can be achieved by varying $A_{Ou}C_{Ou}$, by varying $A_{Od}C_{Od}$, or by varying both in combination.

Orifices $O_d$ and $O_u$ can be built conveniently large, (with $O_d$ large enough to pass as much as ¼ of the engine idle flow). The large size of these orifices permits $A_{Ou}C_{Ou}$ and $A_{Od}C_{Od}$ to be controlled to an accuracy uncommon in fuel-air metering systems. Modulation of $A_{Od}C_{Od}$ or $A_{Ou}C_{Ou}$ can be done with large shaped needles, which are also conducive to high accuracy. It should also be clear that either orifice $O_u$ or $O_d$ could be replaced by two or more orifices in parallel, for instance $$A_{Ou}C_{Ou}=\Sigma_iA_iC_i \quad (24)$$

i=1,2, . . . n.

In this way, several stepped needles, each set to compensate for an engine variable and each having a limited range of authority, can be built into the two orifice in series analogy system which regulates $\Delta P_f$. Because of the large absolute sizes of the orifices $O_u$ and $O_d$, and the simplicity of the relation $$\dot{M}_a/\dot{M}_f\cong A_{Ou}C_{Ou}/A_{Od}C_{Od}$$

programmed modulation of orifice areas for $O_d$ and $O_u$ offers an excellent way of programming the system to achieve any specified $$\dot{M}_a/\dot{M}_f=f(\theta,\ \mathrm{IMV},\ \mathrm{T},\ P_{atm},\ \ldots). \quad (1)$$

The above analysis is exact if the fluid mechanical details described in the drawings are properly attended to. A reasonably skilled fluid mechanical designer, proceding with design according to the present invention, should have his system fit its basic equations within an accuracy of roughly ±one half of one percent. The designer should also be able to quickly pinpoint troubles, and also rationally program the system. For example, in FIG. 3 connecting rod 98 and compensating rod 70 are not of the same diameter and in consquence the air fuel ratio of the metering system will tend to richen at very low intake manifold vacuums. The exact effect for specific values of rod diameters should be clear, and should fit mathematics very closely. Similarly, changing the shape of entrance curvature surfaces 176 as in FIG. 5A can serve to shift the air fuel ratio of the metering system as some systematic function of throttle shaft angle $\theta$.

Very exact analysis of the dynamic response of the metering system is possible. Since the fuel valve and air valve are on the same shaft, there is no lag between fuel valve and air valve opening, but lags do occur because it takes finite time for equilibration to happen in the two orifice in series system and in the fuel regulator servo valve system. The time for equilibrium in the two orifice in series air flow bypass system is extremely fast. Typically, 1/e response of the analogy passage occurs in approximately the time it takes for the downstream orifice to pass the mass flow required to change the density in the volume between the two orifices to equilibrium value. For a 1 percent change in density this is the time it takes to pass 1 percent of the chamber volume between the orifices past the downstream orifice. This 1/e value can readily be held to something like five milliseconds, which is very fast for a metering system. The equilibration time of the servo controlled fuel valve, for example, the time for axial adjustment of piston rod 95 in FIG. 3, is not so fast as adjustment in the air bypass system itself, but can be made extremely fast. The rate at which the fuel servo equilibrates is mostly determined by the laminar flow damping coefficient of cigarette filter 102, which can be readily controlled. This equilibration time can be tested with an arrangement which puts a quick pulse of fuel into a passage such as 86 of FIG. 3, and which then monitors the time for equilibrium with a piezo electric crystal. The system 1/e can readily be held below 30 milliseconds and therefore the dynamic response to the current metering system can be exceptionally fast. It is worth noting that with orifice sizes corresponding to diaphragm fuel pump pressures the dynamic errors in the metering system during an acceleration are errors from the rich side (which is the safe side) so that nothing analogous to an accelerator pump is required by the function of the metering system curve per se.

We believe that we have now disclosed everything required to permit men skilled in the fluid mechanical and mechanical engineering arts to produce a metering system of simple and relatively inexpensive construction and unprecedented accuracy.

We claim:

1. An air fuel metering system for an internal combustion engine including an intake manifold, an air flow passage feeding said intake manifold, said airflow passage having a variable area air flow orifice valve therein, a fuel flow passage having a variable area flow orifice valve therein, means for controlling in a mutually variable manner the air flow variable orifice area valve and the fuel flow variable orifice area valve whereby the ratio of the effective areas of the air flow orifice area to the fuel flow is maintained in approximate proportion, means to regulate the pressure drop across the fuel orifice to be proportional to the pressure drop across the upstream orifice of a two orifice in series air-flow system consisting of an upstream chamber openly connected to the air pressure upstream of the air flow orifice; an upstream orifice connecting said upstream chamber and an intermediate chamber provided with an air pressure balancing system with one side of said balancing system at upstream chamber pressure and the other side at an intermediate chamber pressure and a downstream orifice connecting said intermediate chamber with a chamber openly connected to the pressure downstream of said variable area air flow orifice valve where the pressure drop across the variable area fuel orifice is regulated with a feed-back fuel flow restriction control which equilibrates when pressure drop across the fuel orifice is in proportion to the force from said air pressure balancing system; and wherein the variable area fuel flow orifice valve obeys the flow relation $$\dot{M}_f = A_f C_f \sqrt{2g\rho_f \Delta P_f}$$

where $A_f = L(A_a)$ (fixed exact functional relation between fuel valve area and air valve area)

where the coefficient of discharge $C_f$ is substantially constant over the Reynolds number range relevant for any set $A_f$ and where $\Delta P_f$ is the fuel pressure differential across the valve at well defined pressure tap positions and wherein the variable area air flow orifice valve obeys the flow relation $$\dot{M}_a = \Phi A_a C_a \sqrt{2g\sigma\rho_a(\Delta P_a)}$$

where $A_f = g(A_a)$ in an exact mathematical relation and where $A_f$ and $A_a$ vary in rough proportion where the air valve is so shaped that $C_a$ is effectively invariant over the operating range of Mach number of the device, where $\Delta P_a$ is the difference between upstream stagnation pressure and downstream vena contracta static pressure and wherein the means to regulate the pressure drop across the fuel orifice to be proportional to the pressure drop across the upstream orifice of a two orifice in series flow system obeys one of the following equations $$\Delta P_f = K_1 \Delta P_{Ou} + K_2 \text{ or}$$

$$\Delta P_f = K_3 \Delta P_{Ou} + K_3 P_{fuel\ downstream}$$

and where $\Delta P_{Ou}$ is the $\Delta P$ across an upstream orifice where the system of two orifices in series has an upstream orifice $O_u$ and a downstream orifice $O_d$ where each orifice obeys the following equation $$\dot{M}aoi = \Phi oi Aoi Coi \sqrt{2g\ \sigma oi \rho oi(\Delta Poi)}$$

and where $$A_{Od} C_{Od} << A_{Ou} C_{Ou}$$

so that $\Delta P_{Ou}$ is proportional to $\dot{M}_a^2/A_a C_a$ so that $\dot{M}_f/\dot{M}_a$ is regulated to a constant proportion.

2. The invention as set forth in claim 1 and wherein the feed back fuel flow restriction control comprises a cylindrical fuel chamber with a piston valve reciprocably carried therein, first passage means for supplying fuel upstream of the fuel valve in communication with the one end of the piston valve, a second passage means fluidly connecting the downstream side of the fuel valve to the other end of the piston, a fuel discharge passage in communication with the fuel chamber and downstream of the fuel valve orifice and means connecting the downstream side of the air pressure balancing system to the piston valve whereby the $\Delta P$ on the air pressure balancing system produces a force opposing the force produced by the $\Delta P$ across the piston valve so that any imbalance between the two forces causes the piston valve to move in a direction to decrease the force imbalance by changing $\Delta P$ across the fuel valve until equilibrium is reached.

3. The invention as set forth in claim 2 and wherein the fuel discharge passage is perpendicular to the axis of the cylindrical fuel chamber.

4. The invention as set forth in claim 3 and wherein there are provided a plurality of fuel discharge passages radially and symetrically spaced around the cylinder wall so as to substantially eliminate static friction producing side forces which would interfere with translational equilibrium.

5. The invention as set forth in claim 2 and wherein the means connecting the piston valve downstream side of the air pressure balancing system is a rod whereby the pressure differential between the fuel pressure and the air pressure produces an undesirable force and wherein a compensatory rod is connected to the other side of the air pressure balancing system and in pressure communication with said second passage to counteract said undesirable force.

6. The invention as set forth in claim 1 and wherein the air flow orifice valve and fuel flow orifice valve are on the same shaft.

7. The invention as set forth in claim 1 and wherein said air flow orifice valve has a coefficient of discharge $C_a$ which is insensitive to $\Delta P$ variations involving substantial changes in Mach number comprising a smoothly convergent upstream face and a downstream face curved so as to stabilize a parasitic entrained vortex so that the merger of the convergent flow past the valve with the downstream entrained vortex produces a substantially constant vena contracta area and thus a constant coefficient of discharge over the relevant engine operating Mach number range which Mach number range varies in accordance with the air flow orifice valve opening.

8. The inventon as set forth in claim 1 and wherein the Reynolds number insensitive fuel flow orifice comprises an upstream passage having smoothly convergent passage walls to shape the convergent fuel flow streamlines, said orifice having a minimum flow cross sectional variable area, and whereby the flow passage directly downstream of said fuel flow orifice minimum area expands suddenly for complete detachment of the flow streamlines downstream of the fuel flow orifice to minimize pressure recovery from the vena contracta static pressure in said downstream passage, so that said downstream passage pressure approximates said vena contracta static pressure.

9. The invention as set forth in claim 1 and wherein the ratio of the mass of air ($M_a$) with respect to the mass of fuel ($M_f$) may be varied in accordance with engine control variables by changing the ratio of areas of the system of two orifices in series, $A_{Ou}C_{Ou}/A_{Od}C_{Od}$, by changing either the effective flow cross section of the upstream orifice ($O_u$) or the effective flow cross section of the downstream orifice ($O_d$).

10. The invention as set forth in claim 1 and wherein the system of two orifices in series consists of orifices which are both substantially insensitive to variations in Reynolds number and Mach number where each orifice obeys the following equation:

$$\dot{M}aoi = \Phi 2oi A oi Coi \sqrt{2g\ \sigma oi\ \rho oi(\Delta Poi)}$$

11. The invention as set forth in claim 2 and wherein the first passage means for fuel supply upstream of the valve is provided with a fuel passage connecting with said one end of the piston valve and said fuel passage is provided with a fluid resistance means to damp oscillation of the regulative feed back fuel flow restriction control.

12. The invention as set forth in claim 11 and wherein the resistance means is a laminar flow resistance.

13. The invention as set forth in claim 1 and wherein fuel supply means is fluidly connected to the fuel flow passage, said fuel supply means supplying fuel at a pressure reasonably constant over short periods of the time.

14. The invention as set forth in claim 13 and wherein the fuel supply means includes an accumulator for damping purposes.

15. The invention as set forth in claim 2 and wherein the feed back fuel flow restriction control comprises a cylindrical fuel chamber with a piston valve reciprocally carried therein, first passage means for supply fuel upstream of the fuel valve in communication with the one end of the piston valve, a second passage means fluidly connecting the downstream side of the fuel valve to the other end of the piston, a fuel discharge passage in communication with the fuel chamber, wherein the projected pressure forces due to pressure differential between said discharge passage and the fuel chamber are substantially perpendicular to the axis of the fuel chamber and also with the fuel discharge passage downstream of the fuel valve orifice, and means connecting the downstream side of the air pressure balancing system to the piston valve whereby the $\Delta P$ on the air pressure balancing system produces a force opposing the force produced by the $\Delta P$ across the piston valve so that any imbalance between the two forces causes the piston valve to move in a direction to decrease the force imbalance by changing the $\Delta P$ across the fuel valve until equilibrium is reached, and whereby said equilibrium is insensitive to the value of the substantially perpendicular force due to the pressure differential across said piston valve between said fuel chamber and said discharge passage.

16. The invention as set forth in claim 6 and wherein each valve has a geometrical projected area responding to the equation $A_i = b(K - \cos \Phi)$ where $K \leqq 1$ and $\Phi$ is a given shaft angle.

17. The invention as set forth in claim 1 and wherein the air flow orifice valve and the fuel flow orifice valve each have a geometrical projected area responding to the equation $A_i = b(K - \cos \Phi)$ where $K \leqq 1$ and $\Phi$ is the matched angle of rotation for each valve.

18. The invention as set forth in claim 5 and wherein the air pressure balancing system includes a piston-like member responsive to the pressure differential between the fuel pressure and the air pressure said piston-like member being responsive to extremely low pressure differences, and wherein the rod is connected to the piston-like member.

19. The invention as set forth in claim 18 and wherein the piston-like member is a diaphragm.

20. The invention as set forth in claim 18 and wherein the piston-like member is a piston.

21. The invention as set forth in claim 5 and wherein said compensatory rod diameter is larger than said piston valve connecting rod diameter so that said undesirable force is overbalanced by the force of said compensatory rod whereby the feedback fuel flow restriction control acts to enrich the fuel air mixture at low values of $\Delta P_a$.

22. The invention as set forth in claim 14 and wherein the accumulator does not accumulate volume of fuel below a set minimum fuel pressure and accumulates and discharges fuel volume readily above said minimum pressure.

23. The invention as set forth in claim 2 and wherein the fuel discharge passage is also connected to the air flow directly downstream of said variable area air flow orifice.

24. The invention as set forth in claim 23 and wherein the variable area air flow orifice is a pivoting valve and the fuel is introduced into the high velocity stream directly downstream of said valve.

25. The invention as set forth in claim 24 and wherein the fuel is introduced into the air flow directly downstream of the pivoting valve through a plurality of openings so as to be progressively opened to the downstream side of said valve as the valve is pivotally opened.

26. The invention as set forth in claim 25 and wherein at least one opening is always exposed to the downstream air flow.

27. The invention as set forth in claim 8 and wherein the variable area fuel flow orifice is a rotary plug valve and comprises a cylindrical sleeve apertured to cooperate with a rotatable plug having a rectangular cutout portion registering with the opening in said sleeve to control fuel flow and further wherein the relationship of the sleeve aperture with respect to the plug cutout portion has a geometrically projected area of opening responding to the equation $A=b(K-\cos\Phi)$ where $K\leqq 1$ and $\Phi$ is the angle of relative rotation for the valve.

28. The invention as set forth in claim 2 and wherein means are provided to move the piston valve to close off the fuel discharge passage where the pressure in the first passage falls below a specific level thereby eliminating fuel evaporative emissions.

29. The invention as set forth in claim 1 and wherein the two orifice in series air-flow system is arranged with an upstream orifice connecting to an intermediate chamber flow passage shaped so that a fraction of the maximum pressure drop across said upstream orifice is recovered in said flow passage so that the stagnation pressure of the air directly upstream of the downstream orifice is at a pressure significantly higher than the minimum static pressure downstream of said upstream orifice in said passage due to the pressure recovery of said intermediate chamber flow passage and where the air pressure balancing system with one side of said balancing system at upstream chamber pressure has connections with said intermediate chamber flow passage so that the other side of said balancing system is at a pressure less than the stagnation pressure directly upstream of said downstream orifice.

30. The invention as stated in claim 29 and wherein connections between said air balancing system and said pressure recovering intermediate chamber flow passage are arranged so that the difference between upstream chamber pressure and stagnation pressure directly upstream of the downstream orifice is approximately one half of the pressure difference across said air pressure balancing system.

* * * * *